US008366836B2

(12) United States Patent
Ushigami et al.

(10) Patent No.: US 8,366,836 B2
(45) Date of Patent: Feb. 5, 2013

(54) MANUFACTURING METHOD OF GRAIN-ORIENTED ELECTRICAL STEEL SHEET

(75) Inventors: Yoshiyuki Ushigami, Tokyo (JP); Norikazu Fujii, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 13/381,294

(22) PCT Filed: Jul. 13, 2010

(86) PCT No.: PCT/JP2010/061818

§ 371 (c)(1),
(2), (4) Date: Dec. 28, 2011

(87) PCT Pub. No.: WO2011/007771

PCT Pub. Date: Jan. 20, 2011

(65) Prior Publication Data

US 2012/0103474 A1 May 3, 2012

(30) Foreign Application Priority Data

Jul. 13, 2009 (JP) ..... 2009-165011
Jul. 13, 2009 (JP) ..... 2009-165058
Jan. 25, 2010 (JP) ..... 2010-013247

(51) Int. Cl.
*H01F 1/147* (2006.01)

(52) U.S. Cl. ..... 148/111; 148/113; 148/308

(58) Field of Classification Search ..... None
See application file for complete search history.

(56) References Cited

U.S. PATENT DOCUMENTS 3,905,842 A 9/1975 Grenoble
3,905,843 A 9/1975 Fiedler
3,932,234 A 1/1976 Imanaka et al.
4,929,286 A 5/1990 Komatsu et al.
4,979,997 A 12/1990 Kobayashi et al.
4,994,120 A 2/1991 Takahashi et al.
5,186,762 A 2/1993 Ushigami et al.
5,885,371 A 3/1999 Komatsubara et al.
6,331,215 B1 12/2001 Toge et al.
6,432,222 B2 * 8/2002 Ohata et al. ..... 148/111

(Continued)

FOREIGN PATENT DOCUMENTS

JP 30-3651 5/1955
JP 33-4710 6/1958

(Continued)

OTHER PUBLICATIONS

H. E. Grenoble, "The Role of Solutes in the Secondary Recrystallization of Silicon Iron", IEE Transactions on Magnetics vol. MAG-13, No. 5, pp. 1427-1432, 1977.

(Continued)

*Primary Examiner* — John Sheehan
(74) *Attorney, Agent, or Firm* — Birch, Stewart, Kolasch & Birch, LLP

(57) ABSTRACT

A silicon steel material is heated in a predetermined temperature range according to contents of B, N, Mn, S, and Se (step S1), and is subjected to hot rolling (step S2). Further, a finish temperature Tf of finish rolling in the hot rolling is performed in a predetermined temperature range according to the content of B. Through these treatments, a certain amount of BN is made to precipitate compositely on MnS and/or MnSe.

25 Claims, 9 Drawing Sheets

U.S. PATENT DOCUMENTS

| | | | | |
|---|---|---|---|---|
| 6,444,051 | B2 | 9/2002 | Komatsubara et al. | |
| 7,976,645 | B2 * | 7/2011 | Ushigami et al. | 148/111 |
| 2002/0007870 | A1 | 1/2002 | Ohata et al. | |
| 2002/0011278 | A1 | 1/2002 | Komatsubara et al. | |
| 2009/0126832 | A1 * | 5/2009 | Ushigami et al. | 148/208 |
| 2012/0103474 | A1 | 5/2012 | Ushigami et al. | |
| 2012/0111455 | A1 * | 5/2012 | Ushigami et al. | 148/208 |

FOREIGN PATENT DOCUMENTS

| | | | |
|---|---|---|---|
| JP | 51-13469 | B | 4/1976 |
| JP | 57-207114 | A | 12/1982 |
| JP | 62-45285 | B2 | 9/1987 |
| JP | 1-230721 | A | 9/1989 |
| JP | 1-283324 | A | 11/1989 |
| JP | 2-258929 | A | 10/1990 |
| JP | 3-2324 | A | 1/1991 |
| JP | 10-140243 | A | 5/1998 |
| JP | 11-50153 | A | 2/1999 |
| JP | 11-335736 | A | 12/1999 |
| JP | 2000-129352 | A | 5/2000 |
| JP | 2000-282142 | A | 10/2000 |
| JP | 2001-152250 | A | 6/2001 |
| JP | 2002-348611 | A | 12/2002 |

OTHER PUBLICATIONS

International Search Report, dated Sep. 14, 2010, Issued in PCT/JP2010/061818.

Kuroki et al., "Effect of Precipitation Annealing on the (110) [001] Secondary Recrystallization of 3% Si-Fe", Journal of the Japan Institute of Metals 44, pp. 419-424, 1980.

Kuroki et al., "Inhibitors for Grain Oriented Silicon Steel", Journal of the Japan Institute of Metals 43, pp. 175-181, 1979.

May et al., "Secondary Recrystallization in Silicon Iron", Transactions of The Metallurgical Society of AIME, vol. 212, pp. 769-781, Dec. 1958.

Takashi Matsuoka, "Effect of Impurities on the Secondary Recrystallization in Silicon Iron", The Iron and Steel Institute of Japan (ISIJ), pp. 1007-1023, 1967.

Tatsuo Saito, "Effect of Minor Elements on Normal Grain Growth Rate in Singly Oriented Si-Steel", Journal of the Japan Institute of Metals 27, pp. 186-191, 1963.

Ushigami et al., "Precipitation Behaviors of Injected Nitride Inhibitors during Secondary Recrystallization Annealing in Grain Oriented Silicon Steel", Materials Science Forum vols. 204-206, pp. 593-598, 1996.

Written Opinion of the International Searching Authority, dated Sep. 14, 2010, issued in PCT/JP2010/061818.

Non-Final Office Action dated Jun. 13, 2012, issued in copending U.S. Appl. No. 13/261,144.

Form PCT/IB/338 mailed Feb. 16, 2012.

Form PCT/IB/373 dated Feb. 7, 2012.

Form PCT/ISA/237 dated Sep. 14, 2010.

* cited by examiner

MANUFACTURING METHOD OF GRAIN-ORIENTED ELECTRICAL STEEL SHEET

TECHNICAL FIELD

The present invention relates to a manufacturing method of a grain-oriented electrical steel sheet suitable for an iron core or the like of an electrical apparatus.

BACKGROUND ART

A grain-oriented electrical steel sheet is a soft magnetic material, and is used for an iron core or the like of an electrical apparatus such as a transformer. In the grain-oriented electrical steel sheet, Si of about 7 mass % or less is contained. Crystal grains of the grain-oriented electrical steel sheet are highly integrated in the {110}<001> orientation by Miller indices. The orientation of the crystal grains is controlled by utilizing a catastrophic grain growth phenomenon called secondary recrystallization.

For controlling the secondary recrystallization, it is important to adjust a structure (primary recrystallization structure) obtained by primary recrystallization before the secondary recrystallization and to adjust a fine precipitate called an inhibitor or a grain boundary segregation element. The inhibitor has a function to preferentially grow, in the primary recrystallization structure, the crystal grains in the {110}<001> orientation and suppress growth of the other crystal grains.

Then, conventionally, there have been made various proposals aimed at precipitating an inhibitor effectively.

However, in conventional techniques, it has been difficult to manufacture a grain-oriented electrical steel sheet having a high magnetic flux density industrially stably.

CITATION LIST

Patent Literature

Patent Literature 1: Japanese Examined Patent Application Publication No. 30-003651

Patent Literature 2: Japanese Examined Patent Application Publication No. 33-004710

Patent Literature 3: Japanese Examined Patent Application Publication No. 51-013469

Patent Literature 4: Japanese Examined Patent Application Publication No. 62-045285

Patent Literature 5: Japanese Laid-open Patent Publication No. 03-002324

Patent Literature 6: U.S. Pat. No. 3,905,842

Patent Literature 7: U.S. Pat. No. 3,905,843

Patent Literature 8: Japanese Laid-open Patent Publication No. 01-230721

Patent Literature 9: Japanese Laid-open Patent Publication No. 01-283324

Patent Literature 10: Japanese Laid-open Patent Publication No. 10-140243

Patent Literature 11: Japanese Laid-open Patent Publication No. 2001-152250

Patent Literature 12: Japanese Laid-open Patent Publication No. 2-258929

Non-Patent Literature

Non-Patent Literature 1: Trans. Met. Soc. AIME, 212 (1958) p 769/781

Non-Patent Literature 2: Journal of The Japan Institute of Metals 27 (1963) p 186

Non-Patent Literature 3: Testu-to-Hagane 53 (1967) p 1007/1023

Non-Patent Literature 4: Journal of The Japan Institute of Metals 43 (1979) p 175/181, Journal of The Japan Institute of Metals 44 (1980) p 419/424

Non-Patent Literature 5: Materials Science Forum 204-206 (1996) p 593/598

Non-Patent Literature 6: IEEE Trans. Mag. MAG-13 p 1427

SUMMARY OF THE INVENTION

Technical Problem

The present invention has an object to provide a manufacturing method of a grain-oriented electrical steel sheet capable of manufacturing a grain-oriented electrical steel sheet having a high magnetic flux density industrially stably.

Solution to Problem

A manufacturing method of a grain-oriented electrical steel sheet according to a first aspect of the present invention includes: at a predetermined temperature, heating a silicon steel material containing Si: 0.8 mass % to 7 mass %, acid-soluble Al: 0.01 mass % to 0.065 mass %, N: 0.004 mass % to 0.012 mass %, Mn: 0.05 mass % to 1 mass %, and B: 0.0005 mass % to 0.0080 mass %, the silicon steel material further containing at least one element selected from a group consisting of S and Se being 0.003 mass % to 0.015 mass % in total amount, a C content being 0.085 mass % or less, and a balance being composed of Fe and inevitable impurities; hot rolling the heated silicon steel material so as to obtain a hot-rolled steel strip; annealing the hot-rolled steel strip so as to obtain an annealed steel strip; cold rolling the annealed steel strip one time or more so as to obtain a cold-rolled steel strip; decarburization annealing the cold-rolled steel strip so as to obtain a decarburization-annealed steel strip in which primary recrystallization is caused; coating an annealing separating agent containing MgO as its main component on the decarburization-annealed steel strip; and causing secondary recrystallization by finish annealing the decarburization-annealed steel strip, wherein the method further comprises performing a nitriding treatment in which an N content of the decarburization-annealed steel strip is increased between start of the decarburization annealing and occurrence of the secondary recrystallization in the finish annealing, the predetermined temperature is, in a case when S and Se are contained in the silicon steel material, a temperature T1 (° C.) or lower, a temperature T2 (° C.) or lower, and a temperature T3 (° C.) or lower, the temperature T1 being expressed by equation (1) below, the temperature T2 being expressed by equation (2) below, and the temperature T3 being expressed by equation (3) below, in a case when no Se is contained in the silicon steel material, the temperature T1 (° C.) or lower, and the temperature T3 (° C.) or lower, in a case when no S is contained in the silicon steel material, the temperature T2 (° C.) or lower, and the temperature T3 (° C.) or lower, a finish temperature Tf of finish rolling in the hot rolling satisfies inequation (4) below, and amounts of BN, MnS, and MnSe in the hot-rolled steel strip satisfy inequations (5), (6), and (7) below.

$$T1=14855/(6.82-\log([Mn]\times[S]))-273 \quad (1)$$

$$T2=10733/(4.08-\log([Mn]\times[Se]))-273 \quad (2)$$

$$T3=16000/(5.92-\log([B]\times[N]))-273 \quad (3)$$

$$Tf\leqq 1000-10000\times[B] \quad (4)$$

$$B_{asBN}\geqq 0.0005 \quad (5)$$

$$[B]-B_{asBN}\leqq 0.001 \quad (6)$$

$$S_{asMnS}+0.5\times Se_{asMnSe}\geqq 0.002 \quad (7)$$

Here, [Mn] represents a Mn content (mass %) of the silicon steel material, [S] represents an S content (mass %) of the silicon steel material, [Se] represents a Se content (mass %) of the silicon steel material, [B] represents a B content (mass %) of the silicon steel material, [N] represents an N content (mass %) of the silicon steel material, $B_{asBN}$ represents an amount of B (mass %) that has precipitated as BN in the hot-rolled steel strip, $S_{asMnS}$ represents an amount of S (mass %) that has precipitated as MnS in the hot-rolled steel strip, and $Se_{asMnSe}$ represents an amount of Se (mass %) that has precipitated as MnSe in the hot-rolled steel strip.

In a manufacturing method of a grain-oriented electrical steel sheet according to a second aspect of the present invention, in the method according to the first aspect, the nitriding treatment is performed under a condition that an N content [N] of a steel strip obtained after the nitriding treatment satisfies inequation (8) below.

$$[N]\geqq 14/27[Al]+14/11[B]+14/47[Ti] \quad (8)$$

Here, [N] represents the N content (mass %) of the steel strip obtained after the nitriding treatment, [Al] represents an acid-soluble Al content (mass %) of the steel strip obtained after the nitriding treatment, and [Ti] represents a Ti content (mass %) of the steel strip obtained after the nitriding treatment.

In a manufacturing method of a grain-oriented electrical steel sheet according to a third aspect of the present invention, in the method according to the first aspect, the nitriding treatment is performed under a condition that an N content [N] of a steel strip obtained after the nitriding treatment satisfies inequation (9) below.

$$[N]\geqq 2/3[Al]+14/11[B]+14/47[Ti] \quad (9)$$

Here, [N] represents the N content (mass %) of the steel strip obtained after the nitriding treatment, [Al] represents an acid-soluble Al content (mass %) of the steel strip obtained after the nitriding treatment, and [Ti] represents a Ti content (mass %) of the steel strip obtained after the nitriding treatment.

Advantageous Effects of Invention

According to the present invention, it is possible to make BN precipitate compositely on MnS and/or MnSe appropriately and to form appropriate inhibitors, so that a high magnetic flux density can be obtained. Further, these processes can be executed industrially stably.

DESCRIPTION OF EMBODIMENTS

Figure 1:
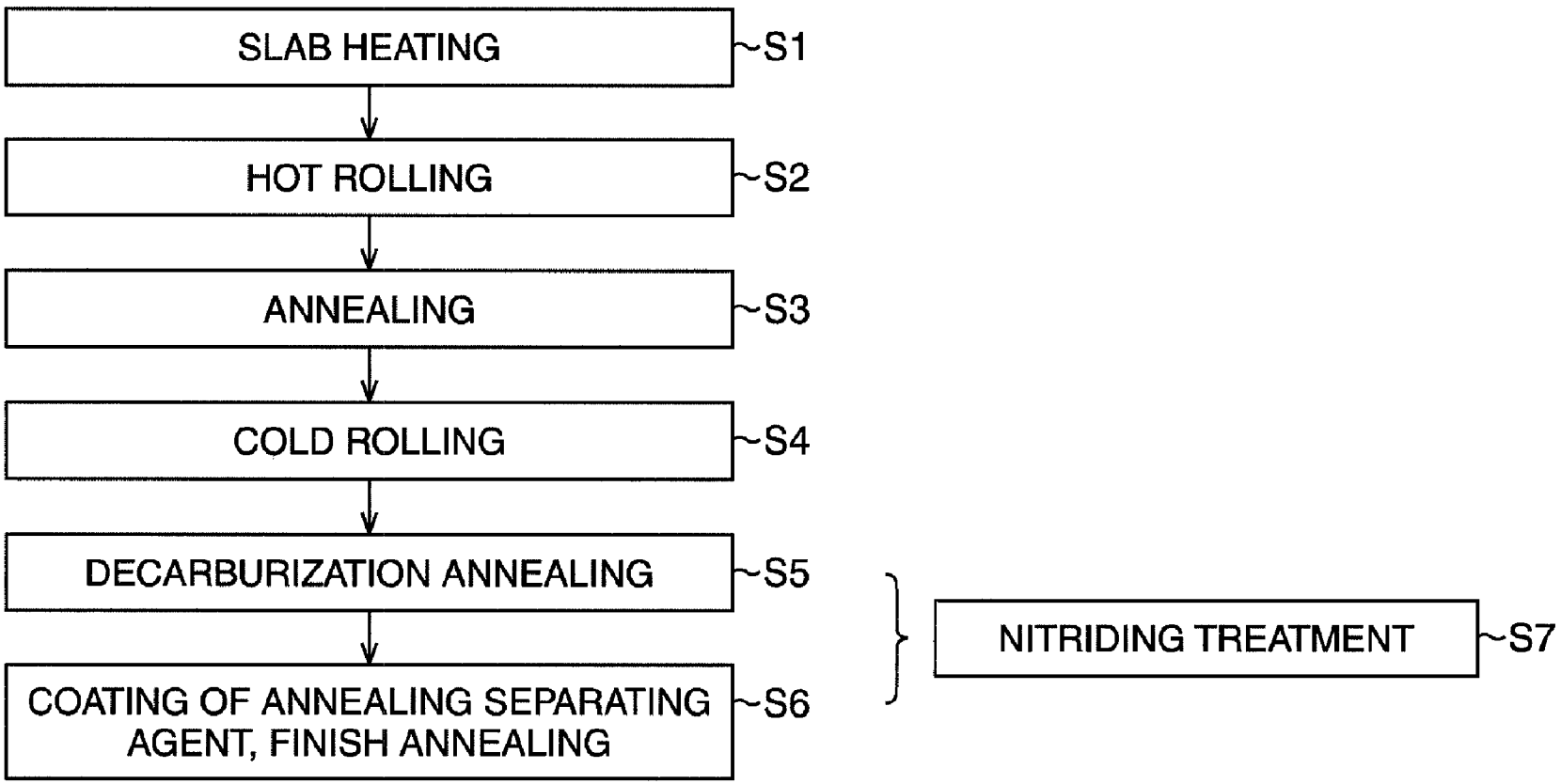
FIG. 1 is a flow chart showing a manufacturing method of a grain-oriented electrical steel sheet.

The present inventors thought that in the case of manufacturing a grain-oriented electrical steel sheet from a silicon steel material having a predetermined composition containing B, a precipitated form of B may affect behavior of secondary recrystallization, and thus conducted various experiments. Here, an outline of a manufacturing method of a grain-oriented electrical steel sheet will be explained. FIG. 1 is a flow chart showing the manufacturing method of the grain-oriented electrical steel sheet.

First, as illustrated in FIG. 1, in step S1, a silicon steel material (slab) having a predetermined composition containing B is heated to a predetermined temperature, and in step S2, hot rolling of the heated silicon steel material is performed. By the hot rolling, a hot-rolled steel strip is obtained. Thereafter, in step S3, annealing of the hot-rolled steel strip is performed to normalize a structure in the hot-rolled steel strip and to adjust precipitation of inhibitors. By the annealing, an annealed steel strip is obtained. Subsequently, in step S4, cold rolling of the annealed steel strip is performed. The cold rolling may be performed only one time, or may also be performed a plurality of times with intermediate annealing being performed therebetween. By the cold rolling, a cold-rolled steel strip is obtained. Incidentally, in the case of the intermediate annealing being performed, it is also possible to omit the annealing of the hot-rolled steel strip before the cold rolling to perform the annealing (step S3) in the intermediate annealing. That is, the annealing (step S3) may be performed on the hot-rolled steel strip, or may also be performed on a steel strip obtained after being cold rolled one time and before being cold rolled finally.

After the cold rolling, in step S5, decarburization annealing of the cold-rolled steel strip is performed. In the decarburization annealing, primary recrystallization occurs. Further, by the decarburization annealing, a decarburization-annealed steel strip is obtained. Next, in step S6, an annealing separating agent containing MgO (magnesia) as its main component is coated on the surface of the decarburization-annealed steel strip and finish annealing is performed. In the finish annealing, secondary recrystallization occurs, and a glass film containing forsterite as its main component is formed on the surface of the steel strip and is purified. As a result of the secondary recrystallization, a secondary recrystallization structure arranged in the Goss orientation is obtained. By the finish annealing, a finish-annealed steel strip is obtained. Further, between start of the decarburization annealing and occurrence of the secondary recrystallization in the finish annealing, a nitriding treatment in which a nitrogen amount of the steel strip is increased is performed (step S7).

In this manner, the grain-oriented electrical steel sheet can be obtained.

Further, details will be described later, but as the silicon steel material, there is used one containing Si: 0.8 mass % to 7 mass %, acid-soluble Al: 0.01 mass % to 0.065 mass %, N: 0.004 mass % to 0.012 mass %, and Mn: 0.05 mass % to 1 mass %, and further containing predetermined amounts of S and/or Se, and B, a C content being 0.085 mass % or less, and a balance being composed of Fe and inevitable impurities.

Then, as a result of the various experiments, the present inventors found that it is important to adjust conditions of slab heating (step S1) and the hot rolling (step S2) to then generate precipitates in a form effective as inhibitors in the hot-rolled steel strip. Concretely, the present inventors found that when B in the silicon steel material precipitates mainly as BN precipitates compositely on MnS and/or MnSe by adjusting the conditions of the slab heating and the hot rolling, the inhibitors are thermally stabilized and grains of a grain structure of the primary recrystallization are homogeneously arranged. Then, the present inventors obtained the knowledge capable of manufacturing the grain-oriented electrical steel sheet having a good magnetic property stably, and completed the present invention.

Here, the experiments conducted by the present inventors will be explained.

First Experiment

In the first experiment, first, various silicon steel slabs containing Si: 3.3 mass %, C: 0.06 mass %, acid-soluble Al: 0.027 mass %, N: 0.008 mass %, Mn: 0.05 mass % to 0.19 mass %, S: 0.007 mass %, and B: 0.0010 mass % to 0.0035 mass %, and a balance being composed of Fe and inevitable impurities were obtained. Next, the silicon steel slabs were heated at a temperature of 1100° C. to 1250° C. and were subjected to hot rolling. In the hot rolling, rough rolling was performed at 1050° C. and then finish rolling was performed at 1000° C., and thereby hot-rolled steel strips each having a thickness of 2.3 mm were obtained. Then, cooling water was jetted onto the hot-rolled steel strips to then let the hot-rolled steel strips cool down to 550° C., and thereafter the hot-rolled steel strips were cooled down in the atmosphere. Subsequently, annealing of the hot-rolled steel strips was performed. Next, cold rolling was performed, and thereby cold-rolled steel strips each having a thickness of 0.22 mm were obtained. Thereafter, the cold-rolled steel strips were heated at a speed of 15° C./s, and were subjected to decarburization annealing at a temperature of 840° C., and thereby decarburization-annealed steel strips were obtained. Subsequently, the decarburization-annealed steel strips were annealed in an ammonia containing atmosphere to increase nitrogen in the steel strips up to 0.022 mass %. Next, an annealing separating agent containing MgO as its main component was coated on the steel strips and finish annealing was performed. In this manner, various samples were manufactured.

Figure 2:
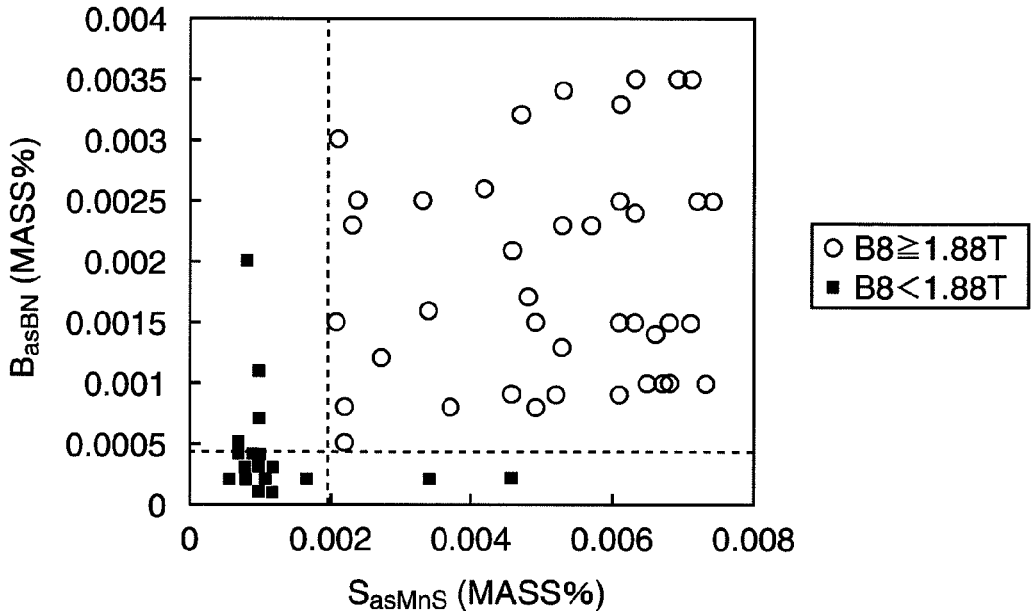
FIG. 2 is a view showing a result of a first experiment (a relationship between precipitates in a hot-rolled steel strip and a magnetic property after finish annealing)

Then, a relationship between precipitates in the hot-rolled steel strip and a magnetic property after the finish annealing was examined. A result of the examination is illustrated in FIG. 2. In FIG. 2, the horizontal axis indicates a value (mass %) obtained by converting a precipitation amount of MnS into an amount of S, and the vertical axis indicates a value (mass %) obtained by converting a precipitation amount of BN into B. The horizontal axis corresponds to an amount of S that has precipitated as MnS (mass %). Further, white circles each indicate that a magnetic flux density B8 was 1.88 T or more, and black squares each indicate that the magnetic flux density B8 was less than 1.88 T. As illustrated in FIG. 2, in the samples each having the precipitation amounts of MnS and BN each being less than a certain value, the magnetic flux density B8 was low. This indicates that secondary recrystallization was unstable.

Figure 3:
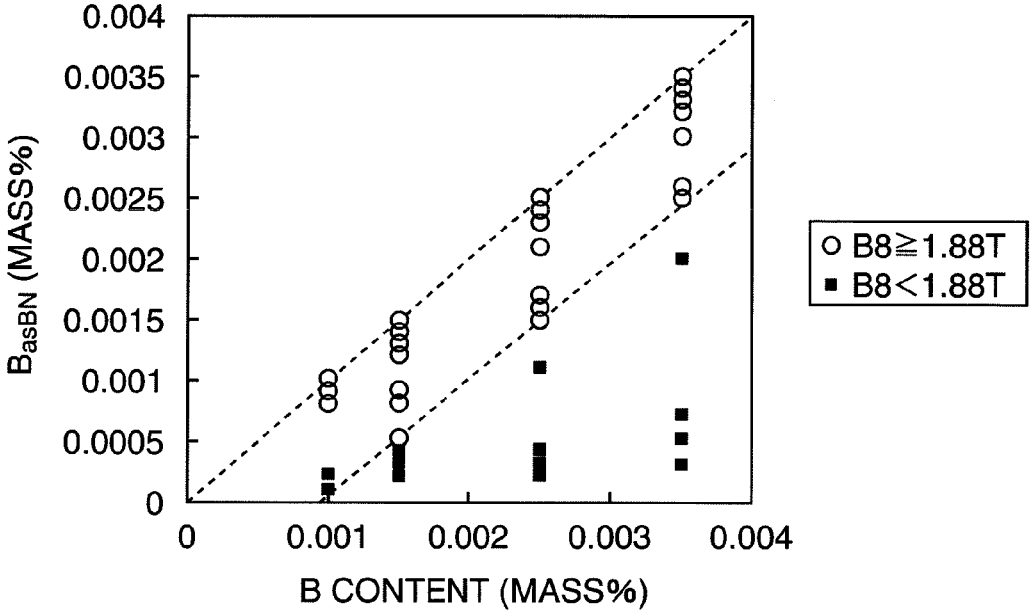
FIG. 3 is a view showing the result of the first experiment (a relationship between an amount of B that has not precipitated as BN and the magnetic property after the finish annealing)

Further, a relationship between an amount of B that has not precipitated as BN and the magnetic property after the finish annealing was examined. A result of the examination is illustrated in FIG. 3. In FIG. 3, the horizontal axis indicates a B content (mass %), and the vertical axis indicates the value (mass %) obtained by converting the precipitation amount of BN into B. Further, white circles each indicate that the magnetic flux density B8 was 1.88 T or more, and black squares each indicate that the magnetic flux density B8 was less than 1.88 T. As illustrated in FIG. 3, in the samples each having the amount of B that has not precipitated as BN being a certain value or more, the magnetic flux density B8 was low. This indicates that the secondary recrystallization was unstable.

Further, as a result of examination of a form of the precipitates in the samples each having the good magnetic property, it turned out that MnS becomes a nucleus and BN precipitates compositely on MnS. Such composite precipitates are effective as inhibitors that stabilize the secondary recrystallization.

Figure 4:
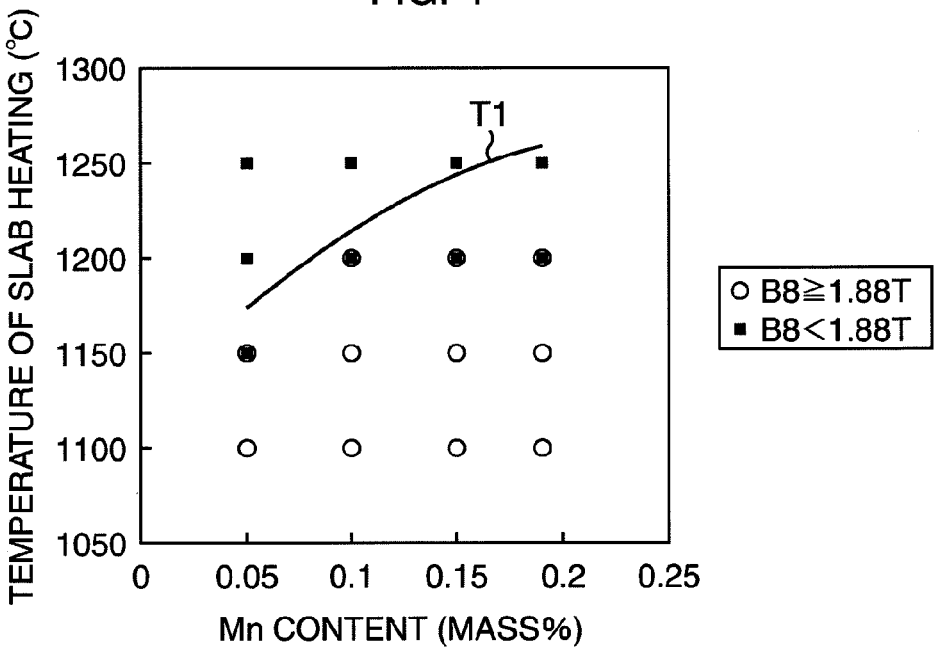
FIG. 4 is a view showing the result of the first experiment (a relationship between a Mn content, a condition of hot rolling, and the magnetic property after the finish annealing)
Figure 5:
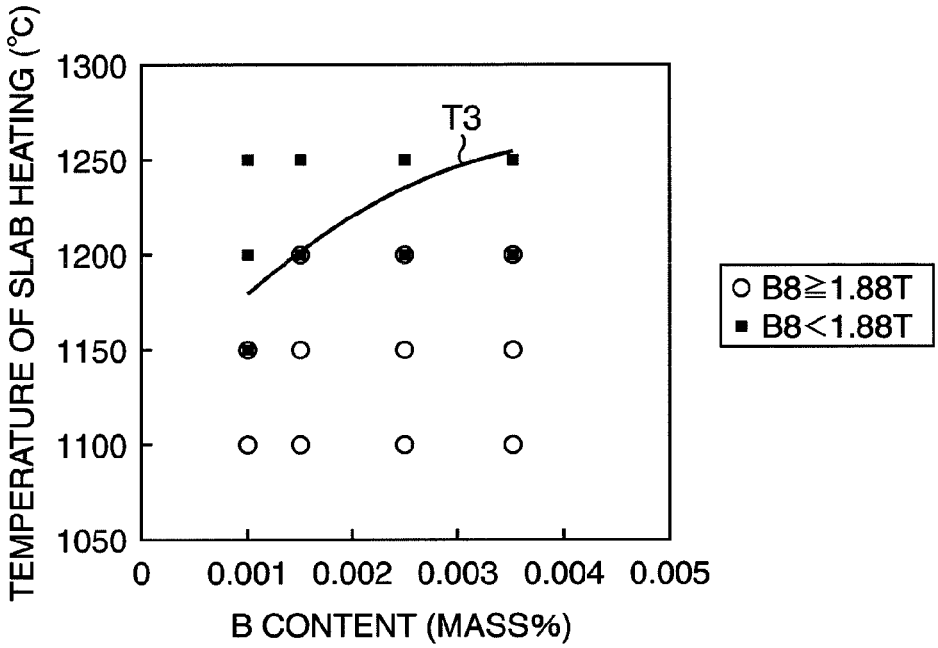
FIG. 5 is a view showing the result of the first experiment (a relationship between a B content, the condition of the hot rolling, and the magnetic property after the finish annealing)

Further, a relationship between a condition of the hot rolling and the magnetic property after the finish annealing was examined. A result of the examination is illustrated in FIG. 4 and FIG. 5. In FIG. 4, the horizontal axis indicates a Mn content (mass %) and the vertical axis indicates a temperature (° C.) of slab heating at the time of hot rolling. In FIG. 5, the horizontal axis indicates the B content (mass %) and the vertical axis indicates the temperature (° C.) of the slab heating at the time of hot rolling. Further, white circles each indicate that the magnetic flux density B8 was 1.88 T or more, and black squares each indicate that the magnetic flux density B8 was less than 1.88 T. Further, a curve in FIG. 4 indicates a solution temperature T1 (° C.) of MnS expressed by equation (1) below, and a curve in FIG. 5 indicates a solution temperature T3 (° C.) of BN expressed by equation (3) below. As illustrated in FIG. 4, it turned out that in the samples in which the slab heating is performed at a temperature determined according to the Mn content or lower, the high magnetic flux density B8 is obtained. Further, it also turned out that the temperature approximately agrees with the solution temperature T1 of MnS. Further, as illustrated in FIG. 5, it also turned out that in the samples in which the slab heating is performed at a temperature determined according to the B content or lower, the high magnetic flux density B8 is obtained. Further, it also turned out that the temperature approximately agrees with the solution temperature T3 of BN. That is, it turned out that it is effective to perform the slab heating in a temperature zone where MnS and BN are not completely solid-dissolved.

$$T1=14855/(6.82-\log([Mn]\times[S]))-273 \quad (1)$$

$$T3=16000/(5.92-\log([B]\times[N]))-273 \quad (3)$$

Here, [Mn] represents the Mn content (mass %), [S] represents an S content (mass %), [B] represents the B content (mass %), and [N] represents an N content (mass %).

Further, as a result of examination of precipitation behavior of BN, it turned out that a precipitation temperature zone of BN is 800° C. to 1000° C.

Further, the present inventors examined a finish temperature of the finish rolling in the hot rolling. Generally, in the finish rolling of the hot rolling, the rolling is performed a plurality of times and thereby a hot-rolled steel strip having a predetermined thickness is obtained. Here, the finish temperature of the finish rolling means the temperature of the hot-rolled steel strip after the final rolling among a plurality of times of rolling. In the examination, first, various silicon steel slabs containing Si: 3.3 mass %, C: 0.06 mass %, acid-soluble Al: 0.027 mass %, N: 0.008 mass %, Mn: 0.1 mass %, S: 0.007 mass %, and B: 0.001 mass % to 0.004 mass %, and a balance being composed of Fe and inevitable impurities were obtained. Next, the silicon steel slabs were heated at a temperature of 1150° C. and were subjected to hot rolling. In the hot rolling, rough rolling was performed at 1050° C. and then finish rolling was performed at 1020° C. to 900° C., and thereby hot-rolled steel strips each having a thickness of 2.3 mm were obtained. Then, cooling water was jetted onto the hot-rolled steel strips to then let the hot-rolled steel strips cool down to 550° C., and thereafter the hot-rolled steel strips were cooled down in the atmosphere. Subsequently, annealing of the hot-rolled steel strips was performed. Next, cold rolling was performed, and thereby cold-rolled steel strips each having a thickness of 0.22 mm were obtained. Thereafter, the cold-rolled steel strips were heated at a rate of 15° C./s, and were subjected to decarburization annealing at a temperature of 840° C., and thereby decarburization-annealed steel strips were obtained. Subsequently, the decarburization-annealed steel strips were annealed in an ammonia containing atmosphere to increase nitrogen in the steel strips up to 0.022 mass %. Next, an annealing separating agent containing MgO as its main component was coated on the steel strips and finish annealing was performed. In this manner, various samples were manufactured.

Figure 6:
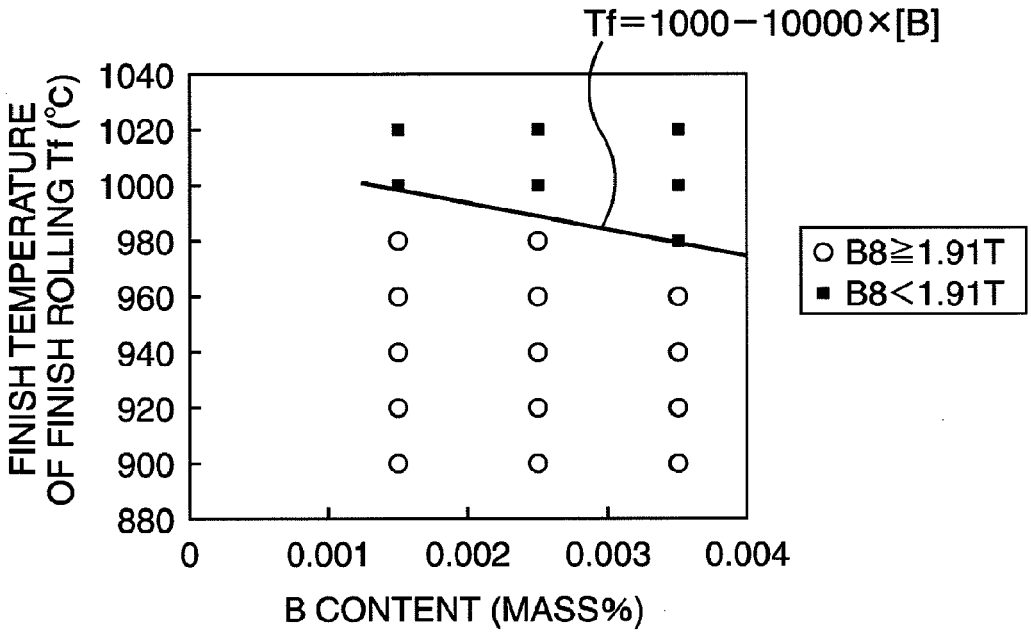
FIG. 6 is a view showing the result of the first experiment (a relationship between a condition of finish rolling and the magnetic property after the finish annealing)

Then, a relationship between the finish temperature of the finish rolling in the hot rolling and a magnetic property after the finish annealing was examined. A result of the examination is illustrated in FIG. 6. In FIG. 6, the horizontal axis indicates a B content (mass %), and the vertical axis indicates a finish temperature Tf of the finish rolling. Further, white circles each indicate that the magnetic flux density B8 was 1.91 T or more, and black squares each indicate that the magnetic flux density B8 was less than 1.91 T. As illustrated in FIG. 6, it turned out that when the finish temperature Tf of the finish rolling satisfies inequation (4) below, the high magnetic flux density B8 is obtained. This is conceivably because by controlling the finish temperature Tf of the finish rolling, the precipitation of BN was further promoted.

$$Tf \leqq 1000-10000\times[B] \quad (4)$$

Second Experiment

In the second experiment, first, various silicon steel slabs containing Si: 3.3 mass %, C: 0.06 mass %, acid-soluble Al: 0.028 mass %, N: 0.007 mass %, Mn: 0.05 mass % to 0.20 mass %, Se: 0.007 mass %, and B: 0.0010 mass % to 0.0035 mass %, and a balance being composed of Fe and inevitable impurities were obtained. Next, the silicon steel slabs were heated at a temperature of 1100° C. to 1250° C. and were subjected to hot rolling. In the hot rolling, rough rolling was performed at 1050° C. and then finish rolling was performed at 1000° C., and thereby hot-rolled steel strips each having a thickness of 2.3 mm were obtained. Then, cooling water was jetted onto the hot-rolled steel strips to then let the hot-rolled steel strips cool down to 550° C., and thereafter the hot-rolled steel strips were cooled down in the atmosphere. Subsequently, annealing of the hot-rolled steel strips was performed. Next, cold rolling was performed, and thereby cold-rolled steel strips each having a thickness of 0.22 mm were obtained. Thereafter, the cold-rolled steel strips were heated at a rate of 15° C./s, and were subjected to decarburization annealing at a temperature of 850° C., and thereby decarburization-annealed steel strips were obtained. Subsequently, the decarburization-annealed steel strips were annealed in an ammonia containing atmosphere to increase nitrogen in the steel strips up to 0.023 mass %. Next, an annealing separating agent containing MgO as its main component was coated on the steel strips and finish annealing was performed. In this manner, various samples were manufactured.

Figure 7:
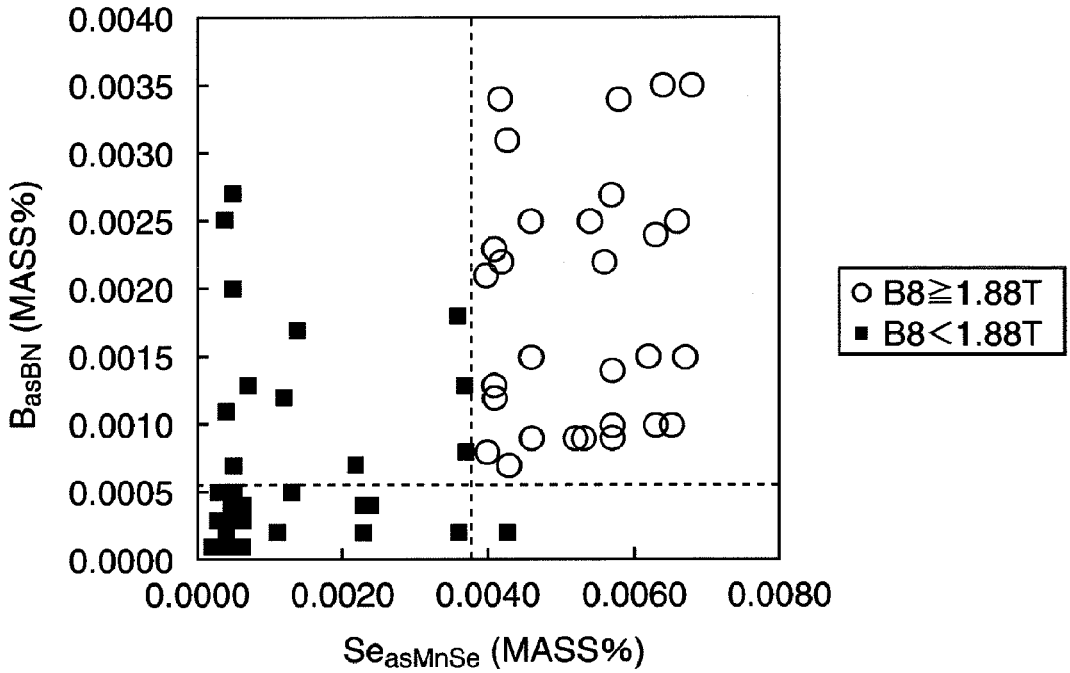
FIG. 7 is a view showing a result of a second experiment (a relationship between precipitates in a hot-rolled steel strip and a magnetic property after finish annealing)

Then, a relationship between precipitates in the hot-rolled steel strip and a magnetic property after the finish annealing was examined. A result of the examination is illustrated in FIG. 7. In FIG. 7, the horizontal axis indicates a value (mass %) obtained by converting a precipitation amount of MnSe into an amount of Se, and the vertical axis indicates a value (mass %) obtained by converting a precipitation amount of BN into B. The horizontal axis corresponds to an amount of Se that has precipitated as MnSe (mass %). Further, white circles each indicate that the magnetic flux density B8 was 1.88 T or more, and black squares each indicate that the magnetic flux density B8 was less than 1.88 T. As illustrated in FIG. 7, in the samples each having the precipitation amounts of MnSe and BN each being less than a certain value, the magnetic flux density B8 was low. This indicates that secondary recrystallization was unstable.

Figure 8:
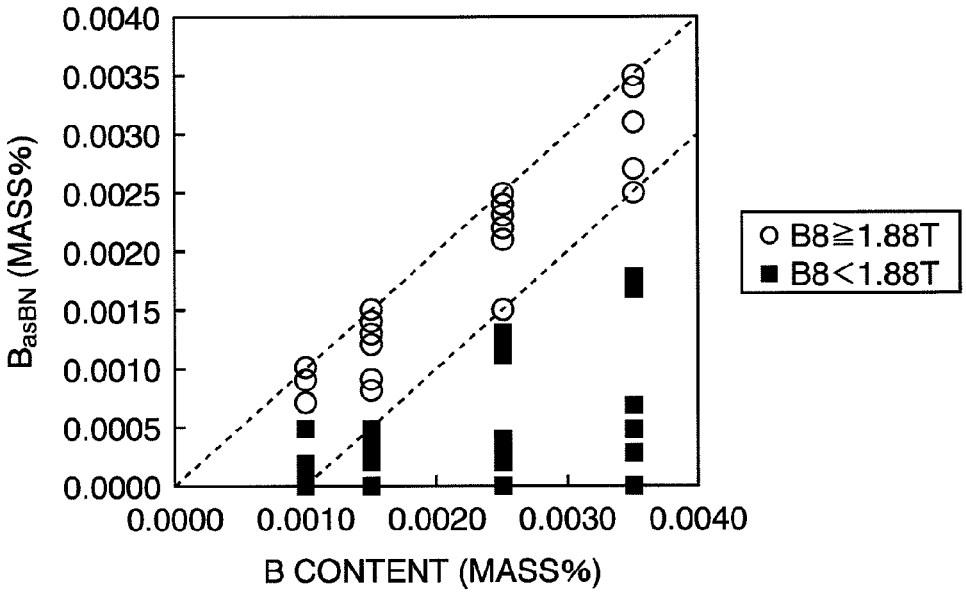
FIG. 8 is a view showing the result of the second experiment (a relationship between an amount of B that has not precipitated as BN and the magnetic property after the finish annealing)

Further, a relationship between an amount of B that has not precipitated as BN and the magnetic property after the finish annealing was examined. A result of the examination is illustrated in FIG. 8. In FIG. 8, the horizontal axis indicates a B content (mass %), and the vertical axis indicates the value (mass %) obtained by converting the precipitation amount of BN into B. Further, white circles each indicate that the magnetic flux density B8 was 1.88 T or more, and black squares each indicate that the magnetic flux density B8 was less than 1.88 T. As illustrated in FIG. 8, in the samples each having the amount of B that has not precipitated as BN being a certain value or more, the magnetic flux density B8 was low. This indicates that the secondary recrystallization was unstable.

Further, as a result of examination of a form of the precipitates in the samples each having the good magnetic property, it turned out that MnSe becomes a nucleus and BN precipitates compositely on MnSe. Such composite precipitates are effective as inhibitors that stabilize the secondary recrystallization.

Figure 9:
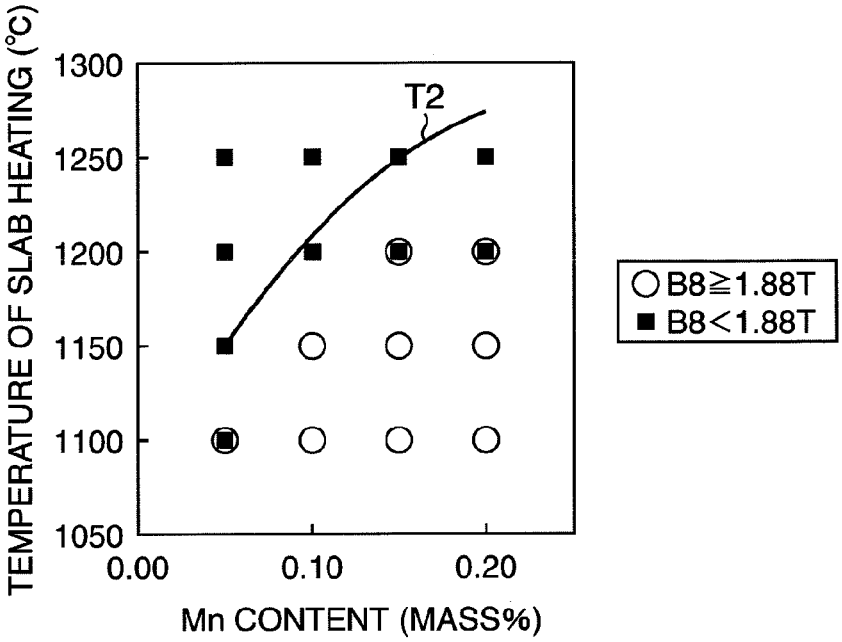
FIG. 9 is a view showing the result of the second experiment (a relationship between a Mn content, a condition of hot rolling, and the magnetic property after the finish annealing)
Figure 10:
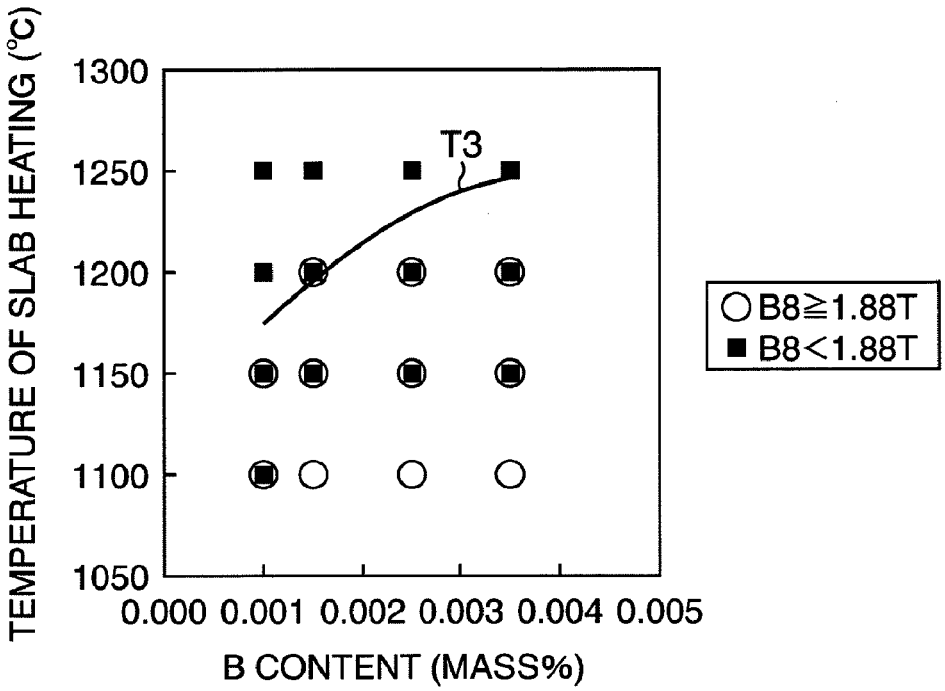
FIG. 10 is a view showing the result of the second experiment (a relationship between a B content, the condition of the hot rolling, and the magnetic property after the finish annealing)

Further, a relationship between a condition of the hot rolling and the magnetic property after the finish annealing was examined. A result of the examination is illustrated in FIG. 9 and FIG. 10. In FIG. 9, the horizontal axis indicates a Mn content (mass %) and the vertical axis indicates a temperature (° C.) of slab heating at the time of hot rolling. In FIG. 10, the horizontal axis indicates the B content (mass %) and the vertical axis indicates the temperature (° C.) of the slab heating at the time of hot rolling. Further, white circles each indicate that the magnetic flux density B8 was 1.88 T or more, and black squares each indicate that the magnetic flux density B8 was less than 1.88 T. Further, a curve in FIG. 9 indicates a solution temperature T2 (° C.) of MnSe expressed by equation (2) below, and a curve in FIG. 10 indicates the solution temperature T3 (° C.) of BN expressed by equation (3). As illustrated in FIG. 9, it turned out that in the samples in which the slab heating is performed at a temperature determined according to the Mn content or lower, the high magnetic flux density B8 is obtained. Further, it also turned out that the temperature approximately agrees with the solution temperature T2 of MnSe. Further, as illustrated in FIG. 10, it also turned out that in the samples in which the slab heating is performed at a temperature determined according to the B content or lower, the high magnetic flux density B8 is obtained. Further, it also turned out that the temperature approximately agrees with the solution temperature T3 of BN. That is, it turned out that it is effective to perform the slab heating in a temperature zone where MnSe and BN are not completely solid-dissolved.

$$T2=10733/(4.08-\log([Mn]\times[Se]))-273 \quad (2)$$

Here, [Se] represents a Se content (mass %).

Further, as a result of examination of precipitation behavior of BN, it turned out that a precipitation temperature zone of BN is 800° C. to 1000° C.

Further, the present inventors examined a finish temperature of the finish rolling in the hot rolling. In the examination, first, various silicon steel slabs containing Si: 3.3 mass %, C: 0.06 mass %, acid-soluble Al: 0.028 mass %, N: 0.007 mass %, Mn: 0.1 mass %, Se: 0.007 mass %, and B: 0.001 mass % to 0.004 mass %, and a balance being composed of Fe and inevitable impurities were obtained. Next, the silicon steel slabs were heated at a temperature of 1150° C. and were subjected to hot rolling. In the hot rolling, rough rolling was performed at 1050° C. and then finish rolling was performed at 1020° C. to 900° C., and thereby hot-rolled steel strips each having a thickness of 2.3 mm were obtained. Then, cooling water was jetted onto the hot-rolled steel strips to then let the hot-rolled steel strips cool down to 550° C., and thereafter the hot-rolled steel strips were cooled down in the atmosphere. Subsequently, annealing of the hot-rolled steel strips was performed. Next, cold rolling was performed, and thereby cold-rolled steel strips each having a thickness of 0.22 mm were obtained. Thereafter, the cold-rolled steel strips were heated at a rate of 15° C./s, and were subjected to decarburization annealing at a temperature of 850° C., and thereby decarburization-annealed steel strips were obtained. Subsequently, the decarburization-annealed steel strips were annealed in an ammonia containing atmosphere to increase nitrogen in the steel strips up to 0.023 mass %. Next, an annealing separating agent containing MgO as its main component was coated on the steel strips and finish annealing was performed. In this manner, various samples were manufactured.

Figure 11:
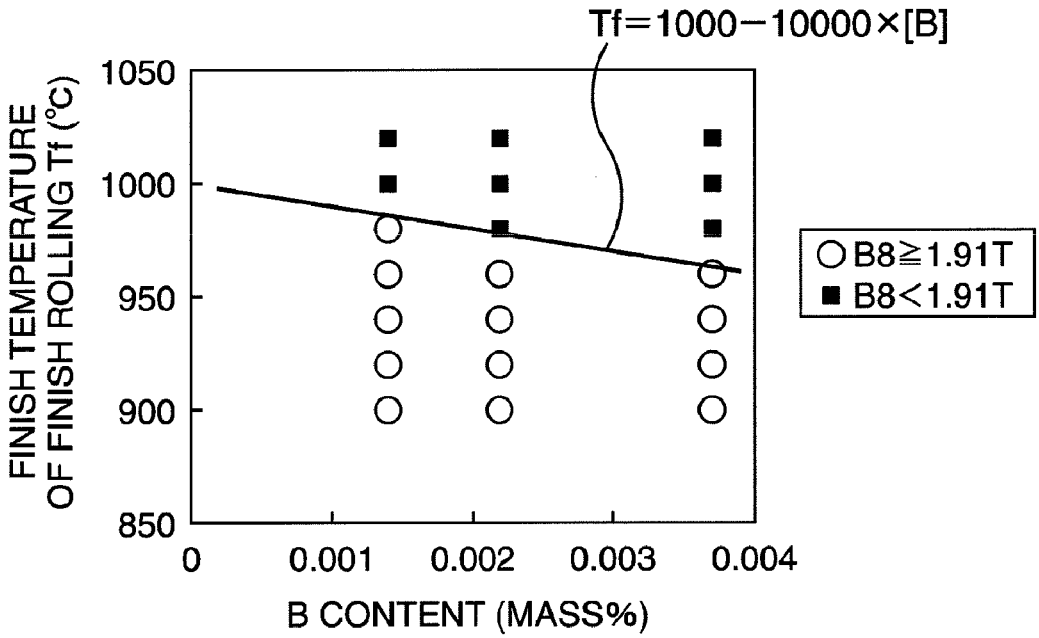
FIG. 11 is a view showing the result of the second experiment (a relationship between a condition of finish rolling and the magnetic property after the finish annealing)

Then, a relationship between the finish temperature of the finish rolling in the hot rolling and a magnetic property after the finish annealing was examined. A result of the examination is illustrated in FIG. 11. In FIG. 11, the horizontal axis indicates a B content (mass %), and the vertical axis indicates the finish temperature Tf of the finish rolling. Further, white circles each indicate that the magnetic flux density B8 was 1.91 T or more, and black squares each indicate that the magnetic flux density B8 was less than 1.91 T. As illustrated in FIG. 11, it turned out that when the finish temperature Tf of the finish rolling satisfies inequation (4), the high magnetic flux density B8 is obtained. This is conceivably because by controlling the finish temperature Tf of the finish rolling, the precipitation of BN was further promoted.

Third Experiment

In the third experiment, first, various silicon steel slabs containing Si: 3.3 mass %, C: 0.06 mass %, acid-soluble Al: 0.026 mass %, N: 0.009 mass %, Mn: 0.05 mass % to 0.20 mass %, S: 0.005 mass %, Se: 0.007 mass %, and B: 0.0010 mass % to 0.0035 mass %, and a balance being composed of Fe and inevitable impurities were obtained. Next, the silicon steel slabs were heated at a temperature of 1100° C. to 1250° C. and were subjected to hot rolling. In the hot rolling, rough rolling was performed at 1050° C. and then finish rolling was performed at 1000° C., and thereby hot-rolled steel strips each having a thickness of 2.3 mm were obtained. Then, cooling water was jetted onto the hot-rolled steel strips to then let the hot-rolled steel strips cool down to 550° C., and thereafter the hot-rolled steel strips were cooled down in the atmosphere. Subsequently, annealing of the hot-rolled steel strips was performed. Next, cold rolling was performed, and thereby cold-rolled steel strips each having a thickness of 0.22 mm were obtained. Thereafter, the cold-rolled steel strips were heated at a rate of 15° C./s, and were subjected to decarburization annealing at a temperature of 850° C., and thereby decarburization-annealed steel strips were obtained. Subsequently, the decarburization-annealed steel strips were annealed in an ammonia containing atmosphere to increase nitrogen in the steel strips up to 0.021 mass %. Next, an annealing separating agent containing MgO as its main component was coated on the steel strips and finish annealing was performed. In this manner, various samples were manufactured.

Figure 12:
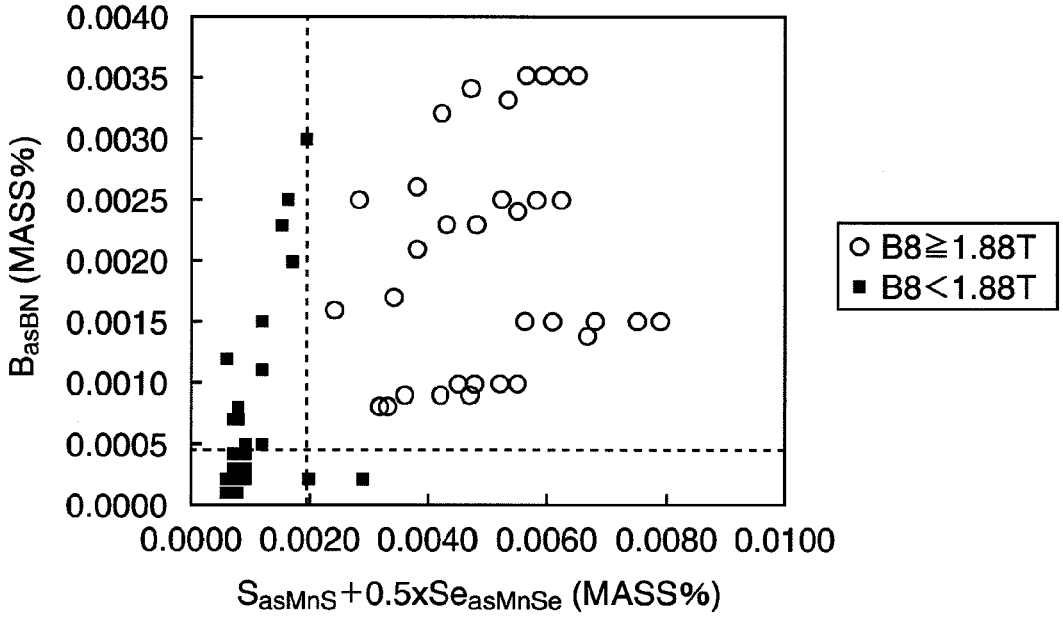
FIG. 12 is a view showing a result of a third experiment (a relationship between precipitates in a hot-rolled steel strip and a magnetic property after finish annealing)

Then, a relationship between precipitates in the hot-rolled steel strip and a magnetic property after the finish annealing was examined. A result of the examination is illustrated in FIG. 12. In FIG. 12, the horizontal axis indicates the sum (mass %) of a value obtained by converting a precipitation amount of MnS into an amount of S and a value obtained by multiplying a value obtained by converting a precipitation amount of MnSe into an amount of Se by 0.5, and the vertical axis indicates a value (mass %) obtained by converting a precipitation amount of BN into B. Further, white circles each indicate that the magnetic flux density B8 was 1.88 T or more, and black squares each indicate that the magnetic flux density B8 was less than 1.88 T. As illustrated in FIG. 12, in the samples each having the precipitation amounts of MnS, MnSe, and BN each being less than a certain value, the magnetic flux density B8 was low. This indicates that secondary recrystallization was unstable.

Figure 13:
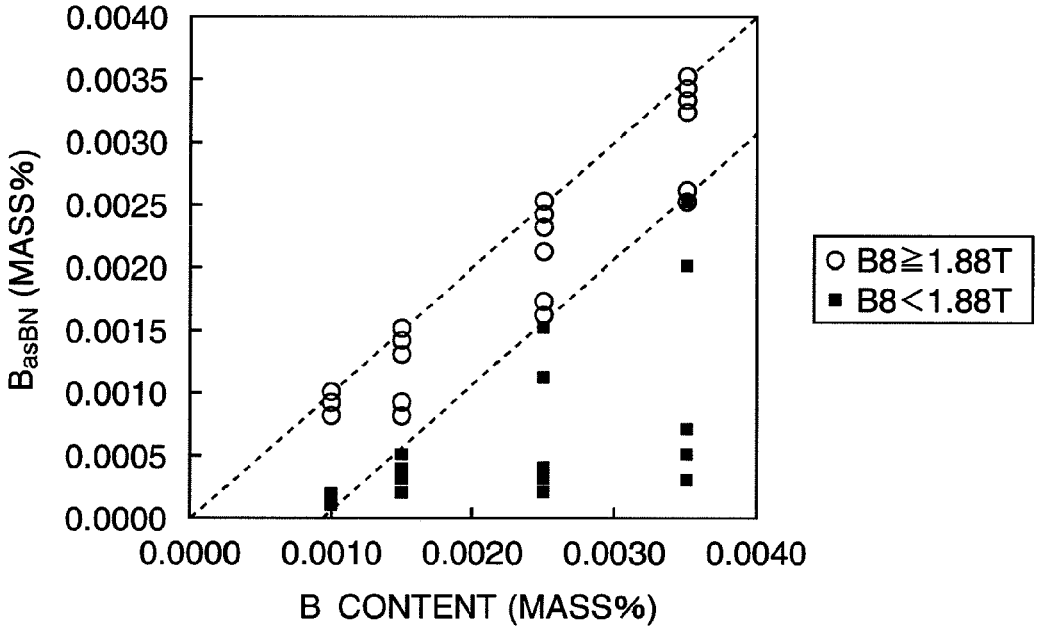
FIG. 13 is a view showing the result of the third experiment (a relationship between an amount of B that has not precipitated as BN and the magnetic property after the finish annealing)

Further, a relationship between an amount of B that has not precipitated as BN and the magnetic property after the finish annealing was examined. A result of the examination is illustrated in FIG. 13. In FIG. 13, the horizontal axis indicates a B content (mass %), and the vertical axis indicates the value (mass %) obtained by converting the precipitation amount of BN into B. Further, white circles each indicate that the magnetic flux density B8 was 1.88 T or more, and black squares each indicate that the magnetic flux density B8 was less than 1.88 T. As illustrated in FIG. 13, in the samples each having the amount of B that has not precipitated as BN being a certain value or more, the magnetic flux density B8 was low. This indicates that the secondary recrystallization was unstable.

Further, as a result of examination of a form of the precipitates in the samples each having the good magnetic property, it turned out that MnS or MnSe becomes a nucleus and BN precipitates compositely on MnS or MnSe. Such composite precipitates are effective as inhibitors that stabilize the secondary recrystallization.

Figure 14:
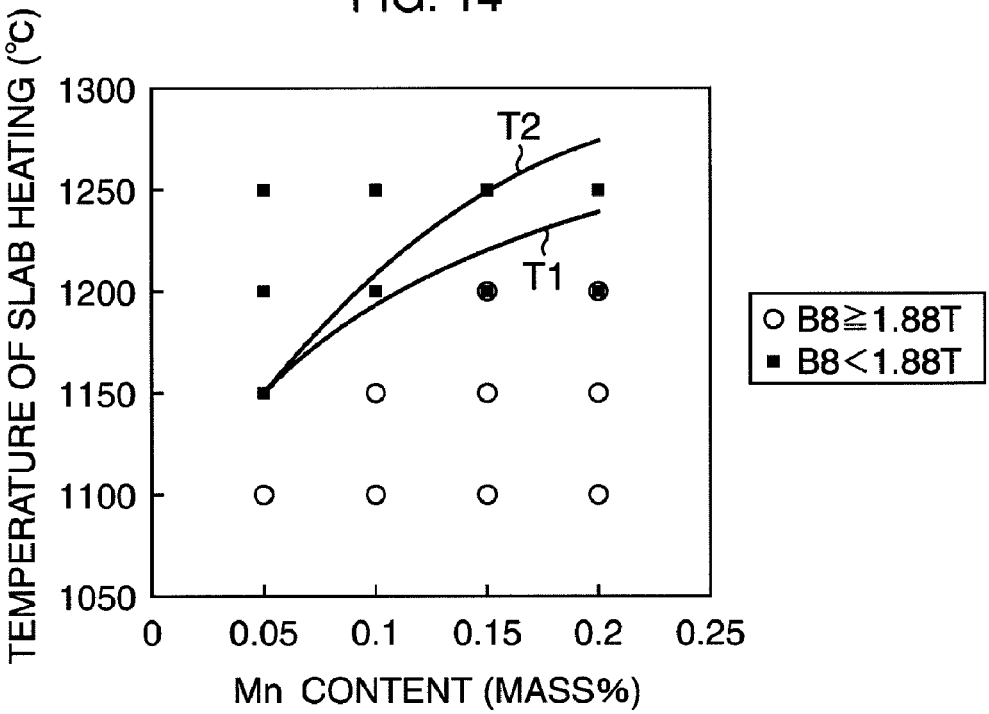
FIG. 14 is a view showing the result of the third experiment (a relationship between a Mn content, a condition of hot rolling, and the magnetic property after the finish annealing)
Figure 15:
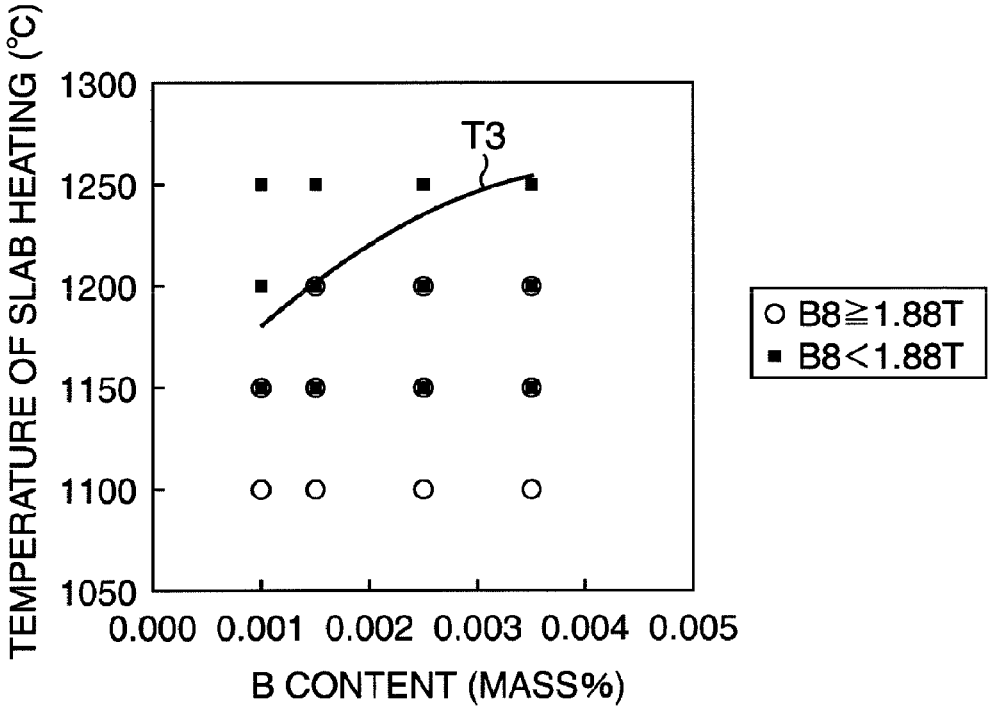
FIG. 15 is a view showing the result of the third experiment (a relationship between a B content, the condition of the hot rolling, and the magnetic property after the finish annealing)

Further, a relationship between a condition of the hot rolling and the magnetic property after the finish annealing was examined A result of the examination is illustrated in FIG. 14 and FIG. 15. In FIG. 14, the horizontal axis indicates a Mn content (mass %) and the vertical axis indicates a temperature (° C.) of slab heating at the time of hot rolling. In FIG. 15, the horizontal axis indicates the B content (mass %) and the vertical axis indicates the temperature (° C.) of the slab heating at the time of hot rolling. Further, white circles each indicate that the magnetic flux density B8 was 1.88 T or more, and black squares each indicate that the magnetic flux density B8 was less than 1.88 T. Further, two curves in FIG. 14 indicate the solution temperature T1 (° C.) of MnS expressed by equation (1) and the solution temperature T2 (° C.) of MnSe expressed by equation (2), and a curve in FIG. 15 indicates the solution temperature T3 (° C.) of BN expressed by equation (3). As illustrated in FIG. 14, it turned out that in the samples in which the slab heating is performed at a temperature determined according to the Mn content or lower, the high magnetic flux density B8 is obtained. Further, it also turned out that the temperature approximately agrees with the solution temperature T1 of MnS and the solution temperature T2 of MnSe. Further, as illustrated in FIG. 15, it also turned out that in the samples in which the slab heating is performed at a temperature determined according to the B content or lower, the high magnetic flux density B8 is obtained. Further, it also turned out that the temperature approximately agrees with the solution temperature T3 of BN. That is, it turned out that it is effective to perform the slab heating in a temperature zone where MnS, MnSe, and BN are not completely solid-dissolved.

Further, as a result of examination of precipitation behavior of BN, it turned out that a precipitation temperature zone of BN is 800° C. to 1000° C.

Further, the present inventors examined a finish temperature of the finish rolling in the hot rolling. In the examination, first, various silicon steel slabs containing Si: 3.3 mass %, C: 0.06 mass %, acid-soluble Al: 0.026 mass %, N: 0.009 mass %, Mn: 0.1 mass %, S: 0.005 mass %, Se: 0.007 mass %, and B: 0.001 mass % to 0.004 mass %, and a balance being composed of Fe and inevitable impurities were obtained. Next, the silicon steel slabs were heated at a temperature of 1150° C. and were subjected to hot rolling. In the hot rolling, rough rolling was performed at 1050° C. and then finish rolling was performed at 1020° C. to 900° C., and thereby hot-rolled steel strips each having a thickness of 2.3 mm were obtained. Then, cooling water was jetted onto the hot-rolled steel strips to then let the hot-rolled steel strips cool down to 550° C., and thereafter the hot-rolled steel strips were cooled down in the atmosphere. Subsequently, annealing of the hot-rolled steel strips was performed. Next, cold rolling was performed, and thereby cold-rolled steel strips each having a thickness of 0.22 mm were obtained. Thereafter, the cold-rolled steel strips were heated at a rate of 15° C./s, and were subjected to decarburization annealing at a temperature of 850° C., and thereby decarburization-annealed steel strips were obtained. Subsequently, the decarburization-annealed steel strips were annealed in an ammonia containing atmosphere to increase nitrogen in the steel strips up to 0.021 mass %. Next, an annealing separating agent containing MgO as its main component was coated on the steel strips and finish annealing was performed. In this manner, various samples were manufactured.

Figure 16:
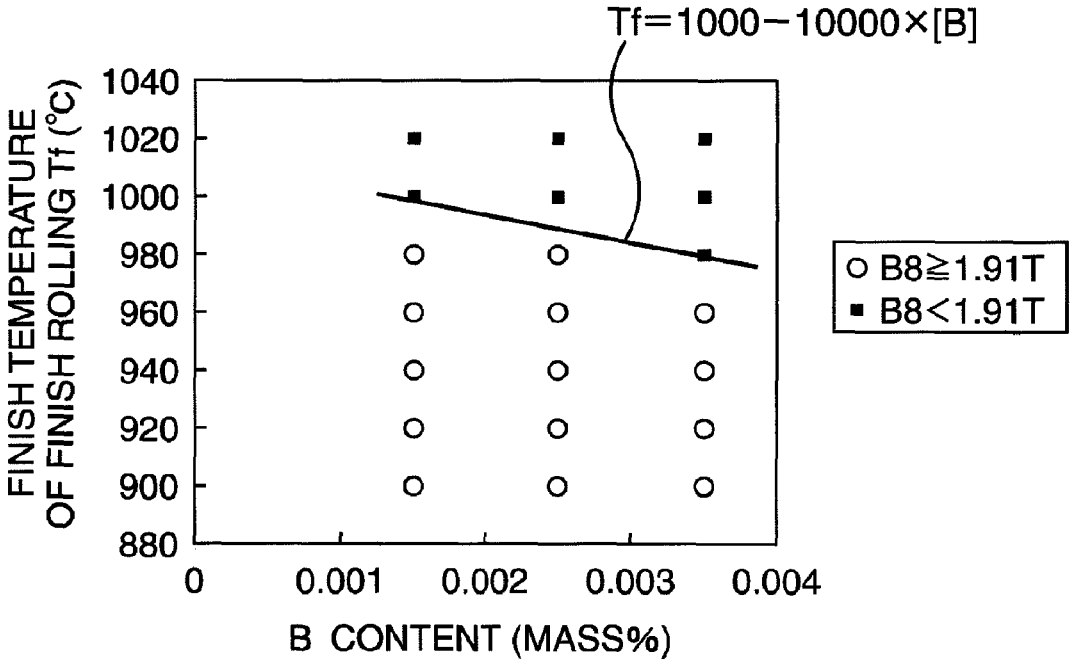
FIG. 16 is a view showing the result of the third experiment (a relationship between a condition of finish rolling and the magnetic property after the finish annealing).

Then, a relationship between the finish temperature of the finish rolling in the hot rolling and a magnetic property after the finish annealing was examined. A result of the examination is illustrated in FIG. 16. In FIG. 16, the horizontal axis indicates a B content (mass %), and the vertical axis indicates the finish temperature Tf of the finish rolling. Further, white circles each indicate that the magnetic flux density B8 was 1.91 T or more, and black squares each indicate that the magnetic flux density B8 was less than 1.91 T. As illustrated in FIG. 16, it turned out that when the finish temperature Tf of the finish rolling satisfies inequation (4), the high magnetic flux density B8 is obtained. This is conceivably because by controlling the finish temperature Tf of the finish rolling, the precipitation of BN was further promoted.

According to these results of the first to third experiments, it is found that controlling the precipitated form of BN makes it possible to stably improve the magnetic property of the grain-oriented electrical steel sheet. The reason why the secondary recrystallization becomes unstable, thereby making it impossible to obtain the good magnetic property in the case when B does not precipitate compositely on MnS or MnSe as BN has not been clarified yet so for, but is considered as follows.

Generally, B in a solid solution state is likely to segregate in grain boundaries, and BN that has precipitated independently after the hot rolling is often fine. B in a solid solution state and fine BN suppress grain growth at the time of primary recrystallization as strong inhibitors in a low-temperature zone where the decarburization annealing is performed, and in a high-temperature zone where the finish annealing is performed, B in a solid solution state and fine BN do not function as inhibitors locally, thereby turning the grain structure into a mixed grain structure with coarse grains. Thus, in the low-temperature zone, primary recrystallized grains are small, so that the magnetic flux density of the grain-oriented electrical steel sheet is reduced. Further, in the high-temperature zone, the grain structure is turned into the mixed grain structure with coarse grains, so that the secondary recrystallization becomes unstable.

Next, an embodiment of the present invention made on the knowledge will be explained.

First, limitation reasons of the components of the silicon steel material will be explained.

The silicon steel material used in this embodiment contains Si: 0.8 mass % to 7 mass %, acid-soluble Al: 0.01 mass % to 0.065 mass %, N: 0.004 mass % to 0.012 mass %, Mn: 0.05 mass % to 1 mass %, S and Se: 0.003 mass % to 0.015 mass % in total amount, and B: 0.0005 mass % to 0.0080 mass %, and a C content being 0.085 mass % or less, and a balance being composed of Fe and inevitable impurities.

Si increases electrical resistance to reduce a core loss. However, when a Si content exceeds 7 mass %, the cold rolling becomes difficult to be performed, and a crack is likely to be caused at the time of cold rolling. Thus, the Si content is set to 7 mass % or less, and is preferably 4.5 mass % or less, and is more preferably 4 mass % or less. Further, when the Si content is less than 0.8 mass %, a γ transformation is caused at the time of finish annealing to thereby make a crystal orientation of the grain-oriented electrical steel sheet deteriorate. Thus, the Si content is set to 0.8 mass % or more, and is preferably 2 mass % or more, and is more preferably 2.5 mass % or more.

C is an element effective for controlling the primary recrystallization structure, but adversely affects the magnetic property. Thus, in this embodiment, before the finish annealing (step S6), the decarburization annealing is performed (step S5). However, when the C content exceeds 0.085 mass %, a time taken for the decarburization annealing becomes long, and productivity in industrial production is impaired. Thus, the C content is set to 0.85 mass % or less, and is preferably 0.07 mass % or less.

Acid-soluble Al bonds to N to precipitate as (Al, Si)N and functions as an inhibitor. In the case when a content of acid-soluble Al falls within a range of 0.01 mass % to 0.065 mass %, the secondary recrystallization is stabilized. Thus, the content of acid-soluble Al is set to be not less than 0.01 mass % nor more than 0.065 mass %. Further, the content of acid-soluble Al is preferably 0.02 mass % or more, and is more preferably 0.025 mass % or more. Further, the content of acid-soluble Al is preferably 0.04 mass % or less, and is more preferably 0.03 mass % or less.

B bonds to N to precipitate compositely on MnS or MnSe as BN and functions as an inhibitor. In the case when a B content falls within a range of 0.0005 mass % to 0.0080 mass %, the secondary recrystallization is stabilized. Thus, the B content is set to be not less than 0.0005 mass % nor more than 0.0080 mass %. Further, the B content is preferably 0.001% or more, and is more preferably 0.0015% or more. Further, the B content is preferably 0.0040% or less, and is more preferably 0.0030% or less.

N bonds to B or Al to function as an inhibitor. When an N content is less than 0.004 mass %, it is not possible to obtain a sufficient amount of the inhibitor. Thus, the N content is set to 0.004 mass % or more, and is preferably 0.006 mass % or more, and is more preferably 0.007 mass % or more. On the other hand, when the N content exceeds 0.012 mass %, a hole called a blister occurs in the steel strip at the time of cold rolling. Thus, the N content is set to 0.012 mass % or less, and is preferably 0.010 mass % or less, and is more preferably 0.009 mass % or less.

Mn, S and Se produce MnS and MnSe to be a nucleus on which BN precipitates compositely, and composite precipitates function as an inhibitor. In the case when a Mn content falls within a range of 0.05 mass % to 1 mass %, the secondary recrystallization is stabilized. Thus, the Mn content is set to be not less than 0.05 mass % nor more than 1 mass %. Further, the Mn content is preferably 0.08 mass % or more, and is more preferably 0.09 mass % or more. Further, the Mn content is preferably 0.50 mass % or less, and is more preferably 0.2 mass % or less.

Further, in the case when a content of S and Se falls within a range of 0.003 mass % to 0.015 mass % in total amount, the secondary recrystallization is stabilized. Thus, the content of S and Se is set to be not less than 0.003 mass % nor more than 0.015 mass % in total amount. Further, in terms of preventing occurrence of a crack in the hot rolling, inequation (10) below is preferably satisfied. Incidentally, only either S or Se may be contained in the silicon steel material, or both S and Se may also be contained in the silicon steel material. In the case when both S and Se are contained, it is possible to promote the precipitation of BN more stably and to improve the magnetic property stably.

$$[Mn]/([S]+[Se]) \geqq 4 \quad (10)$$

Ti forms coarse TiN to affect the precipitation amounts of BN and (Al, Si)N functioning as an inhibitor. When a Ti content exceeds 0.004 mass %, the good magnetic property is not easily obtained. Thus, the Ti content is preferably 0.004 mass % or less.

Further, one or more element(s) selected from a group consisting of Cr, Cu, Ni, P, Mo, Sn, Sb, and Bi may also be contained in the silicon steel material in ranges below.

Cr improves an oxide layer formed at the time of decarburization annealing, and is effective for forming the glass film made by reaction of the oxide layer and MgO being the main component of the annealing separating agent at the time of finish annealing. However, when a Cr content exceeds 0.3 mass %, decarburization is noticeably prevented. Thus, the Cr content may be set to 0.3 mass % or less.

Cu increases specific resistance to reduce a core loss. However, when a Cu content exceeds 0.4 mass %, the effect is saturated. Further, a surface flaw called "copper scab" is sometimes caused at the time of hot rolling. Thus, the Cu content may be set to 0.4 mass % or less.

Ni increases specific resistance to reduce a core loss. Further, Ni controls a metallic structure of the hot-rolled steel strip to improve the magnetic property. However, when a Ni content exceeds 1 mass %, the secondary recrystallization becomes unstable. Thus, the Ni content may be set to 1 mass % or less.

P increases specific resistance to reduce a core loss. However, when a P content exceeds 0.5 mass %, a fracture occurs easily at the time of cold rolling due to embrittlement. Thus, the P content may be set to 0.5 mass % or less.

Mo improves a surface property at the time of hot rolling. However, when a Mo content exceeds 0.1 mass %, the effect is saturated. Thus, the Mo content may be set to 0.1 mass % or less.

Sn and Sb are grain boundary segregation elements. The silicon steel material used in this embodiment contains Al, so that there is sometimes a case that Al is oxidized by moisture released from the annealing separating agent depending on the condition of the finish annealing. In this case, variations in inhibitor strength occur depending on the position in the grain-oriented electrical steel sheet, and the magnetic property also sometimes varies. However, in the case when the grain boundary segregation elements are contained, the oxidation of Al can be suppressed. That is, Sn and Sb suppress the oxidation of Al to suppress the variations in the magnetic property. However, when a content of Sn and Sb exceeds 0.30 mass % in total amount, the oxide layer is not easily formed at the time of decarburization annealing, and thereby the formation of the glass film made by the reaction of the oxide layer and MgO being the main component of the annealing separating agent at the time of finish annealing becomes insufficient. Further, the decarburization is noticeably prevented. Thus, the content of Sn and Sb may be set to 0.3 mass % or less in total amount.

Bi stabilizes precipitates such as sulfides to strengthen the function as an inhibitor. However, when a Bi content exceeds 0.01 mass %, the formation of the glass film is adversely affected. Thus, the Bi content may be set to 0.01 mass % or less.

Next, each treatment in this embodiment will be explained.

The silicon steel material (slab) having the above-described components may be manufactured in a manner that, for example, steel is melted in a converter, an electric furnace, or the like, and the molten steel is subjected to a vacuum degassing treatment according to need, and next is subjected to continuous casting. Further, the silicon steel material may also be manufactured in a manner that in place of the continuous casting, an ingot is made to then be bloomed. The thickness of the silicon steel slab is set to, for example, 150 mm to 350 mm, and is preferably set to 220 mm to 280 mm. Further, what is called a thin slab having a thickness of 30 mm to 70 mm may also be manufactured. In the case when the thin slab is manufactured, the rough rolling performed when obtaining the hot-rolled steel strip may be omitted.

After the silicon steel slab is manufactured, the slab heating is performed (step S1), and the hot rolling (step S2) is performed. Then, in this embodiment, the conditions of the slab heating and the hot rolling are set such that BN is made to precipitate compositely on MnS and/or MnSe, and that the precipitation amounts of BN, MnS, and MnSe in the hot-rolled steel strip satisfy inequations (5) to (7) below.

$$B_{asBN} \geqq 0.0005 \quad (5)$$

$$[B]-B_{asBN} \leqq 0.001 \quad (6)$$

$$S_{asMnS}+0.5\times Se_{asMnSe} \geqq 0.002 \quad (7)$$

Here, "$B_{asBN}$" represents the amount of B that has precipitated as BN (mass %), "$S_{asMnS}$" represents the amount of S that has precipitated as MnS (mass %), and "$Se_{asMnSe}$" represents the amount of Se that has precipitated as MnSe (mass %).

As for B, a precipitation amount and a solid solution amount of B are controlled such that inequation (5) and inequation (6) are satisfied. A certain amount or more of BN is made to precipitate in order to secure an amount of the inhibitors. Further, in the case when the amount of solid-dissolved B is large, there is sometimes a case that unstable fine precipitates are formed in the subsequent processes to adversely affect the primary recrystallization structure.

MnS and MnSe each function as a nucleus on which BN precipitates compositely. Thus, in order to make BN precipitate sufficiently to thereby improve the magnetic property, the precipitation amounts of MnS and MnSe are controlled such that inequation (7) is satisfied.

The condition expressed in inequation (6) is derived from FIG. 3, FIG. 8, and FIG. 13. It is found from FIG. 3, FIG. 8, and FIG. 13 that in the case of $[B]-B_{asBN}$ being 0.001 mass % or less, the good magnetic flux density, being the magnetic flux density B8 of 1.88 T or more, is obtained.

The conditions expressed in inequation (5) and inequation (7) are derived from FIG. 2, FIG. 7, and FIG. 12. It is found that in the case when $B_{asBN}$ is 0.0005 mass % or more and $S_{asMnS}$ is 0.002 mass % or more, the good magnetic flux density, being the magnetic flux density B8 of 1.88 T or more, is obtained from FIG. 2. Similarly, it is found that in the case when $B_{asBN}$ is 0.0005 mass % or more and $Se_{asMnSe}$ is 0.004 mass % or more, the good magnetic flux density, being the magnetic flux density B8 of 1.88 T or more, is obtained from FIG. 7. Similarly, it is found that in the case when $B_{asBN}$ is 0.0005 mass % or more and $S_{asMnS}+0.5\times Se_{asMnSe}$ is 0.002 mass % or more, the good magnetic flux density, being the magnetic flux density B8 of 1.88 T or more, is obtained from FIG. 12. Then, as long as $S_{asMnS}$ is 0.002 mass % or more, $S_{asMnS}+0.5\times Se_{asMnSe}$ becomes 0.002 mass % or more inevitably, and as long as $Se_{asMnSe}$ is 0.004 mass % or more, $S_{asMnS}+0.5\times Se_{asMnSe}$ becomes 0.002 mass % or more inevitably. Thus, it is important that $S_{asMnS}+0.5\times S_{asMnS}+0.5\times Se_{asMnSe}$ is 0.002 mass % or more.

Further, the temperature of the slab heating (step S1) is set so as to satisfy the following conditions.

(i) in the case of S and Se being contained in the silicon steel slab the temperature T1 (° C.) expressed by equation (1) or lower, the temperature T2 (° C.) expressed by equation (2) or lower, and the temperature T3 (° C.) expressed by equation (3) or lower (ii) in the case of no Se being contained in the silicon steel slab the temperature T1 (° C.) expressed by equation (1) or lower and the temperature T3 (° C.) expressed by equation (3) or lower (iii) in the case of no S being contained in the silicon steel slab the temperature T2 (° C.) expressed by equation (2) or lower and the temperature T3 (° C.) expressed by equation (3) or lower $$T1=14855/(6.82-\log([Mn]\times[S]))-273 \quad (1)$$

$$T2=10733/(4.08-\log([Mn]\times[Se]))-273 \quad (2)$$

$$T3=16000/(5.92-\log([B]\times[N]))-273 \quad (3)$$

This is because when the slab heating is performed at such temperatures, BN, MnS, and MnSe are not completely solid-dissolved at the time of slab heating, and the precipitations of BN, MnS, and MnSe are promoted during the hot rolling. As is clear from FIG. 4, FIG. 9, and FIG. 14, the solution temperatures T1 and T2 approximately agree with the upper limit of the slab heating temperature capable of obtaining the magnetic flux density B8 of 1.88 or more. Further, as is clear from FIG. 5, FIG. 10, and FIG. 15, the solution temperature T3 approximately agrees with the upper limit of the slab heating temperature capable of obtaining the magnetic flux density B8 of 1.88 or more.

Further, the temperature of the slab heating is more preferably set so as to satisfy the following conditions as well. This is to make a preferable amount of MnS or MnSe precipitate during the slab heating.

(i) in the case of no Se being contained in the silicon steel slab a temperature T4 (° C.) expressed by equation (11) below or lower (ii) in the case of no S being contained in the silicon steel slab a temperature T5 (° C.) expressed by equation (12) below or lower $$T4=14855/(6.82-\log(([Mn]-0.0034)\times([S]-0.002)))-273 \quad (11)$$

$$T5=10733/(4.08-\log(([Mn]-0.0028)\times([Se]-0.004)))-273 \quad (12)$$

In the case when the temperature of the slab heating is too high, BN, MnS, and/or MnSe are sometimes solid-dissolved completely. In this case, it becomes difficult to make BN, MnS, and/or MnSe precipitate at the time of hot rolling. Thus, the slab heating is preferably performed at the temperature T1 and/or the temperature T2 or lower, and at the temperature T3 or lower. Further, if the temperature of the slab heating is the temperature T4 or T5 or lower, a preferable amount of MnS or MnSe precipitates during the slab heating, and thus it becomes possible to make BN precipitate compositely on MnS or MnSe to form effective inhibitors easily.

Further, as for B, the finish temperature Tf of the finish rolling in the hot rolling is set such that inequation (4) below is satisfied. This is to promote the precipitation of BN.

$$Tf \leqq 1000-10000\times[B] \quad (4)$$

As is clear from FIG. 6, FIG. 11, and FIG. 16, the condition expressed in inequation (4) approximately agrees with the condition capable of obtaining the magnetic flux density B8 of 1.91 T or more. Further, the finish temperature Tf of the finish rolling is preferably set to 800° C. or higher in terms of the precipitation of BN.

After the hot rolling (step S2), the annealing of the hot-rolled steel strip is performed (step S3). Next, the cold rolling is performed (step S4). As described above, the cold rolling may be performed only one time, or may also be performed a plurality of times with the intermediate annealing being performed therebetween. In the cold rolling, the final cold rolling rate is preferably set to 80% or more. This is to develop a good primary recrystallization aggregate structure.

Thereafter, the decarburization annealing is performed (step S5). As a result, C contained in the steel strip is removed. The decarburization annealing is performed in a moist atmosphere, for example. Further, the decarburization annealing is preferably performed at a time such that, for example, a grain diameter obtained by the primary recrystallization becomes 15 μm or more in a temperature zone of 770° C. to 950° C. This is to obtain the good magnetic property. Subsequently, the coating of the annealing separating agent and the finish annealing are performed (step S6). As a result, the grains oriented in the {110}<001> orientation preferentially grow by the secondary recrystallization.

Further, the nitriding treatment is performed between start of the decarburization annealing and occurrence of the secondary recrystallization in the finish annealing (step S7). This is to form an inhibitor of (Al, Si)N. The nitriding treatment may be performed during the decarburization annealing (step S5), or may also be performed during the finish annealing (step S6). In the case when the nitriding treatment is performed during the decarburization annealing, the annealing may be performed in an atmosphere containing a gas having nitriding capability such as ammonia, for example. Further, the nitriding treatment may be performed during a heating zone or a soaking zone in a continuous annealing furnace, or the nitriding treatment may also be performed at a stage after the soaking zone. In the case when the nitriding treatment is performed during the finish annealing, a powder having nitriding capability such as MnN, for example, may be added to the annealing separating agent.

In order to perform the secondary recrystallization more stably, it is desirable to adjust the degree of nitriding in the nitriding treatment (step S7) and to adjust the compositions of (Al, Si)N in the steel strip after the nitriding treatment. For example, according to the Al content, the B content, and the content of Ti existing inevitably, the degree of nitriding is preferably controlled so as to satisfy inequation (8) below, and the degree of nitriding is more preferably controlled so as to satisfy inequation (9) below. Inequation (8) and inequation (9) indicate an amount of N that is preferable to fix B as BN effective as an inhibitor and an amount of N that is preferable to fix Al as AlN or (Al, Si)N effective as an inhibitor.

$$[N] \geqq 14/27[Al]+14/11[B]+14/47[Ti] \quad (8)$$

$$[N] \geqq 2/3[Al]+14/11[B]+14/47[Ti] \quad (9)$$

Here, [N] represents an N content (mass %) of a steel strip obtained after the nitriding treatment, [Al] represents an acid-soluble Al content (mass %) of the steel strip obtained after the nitriding treatment, [B] represents a B content (mass %) of the steel strip obtained after the nitriding treatment, and [Ti] represents a Ti content (mass %) of the steel strip obtained after the nitriding treatment.

The method of the finish annealing (step S6) is also not limited in particular. It should be noted that, in this embodiment, the inhibitors are strengthened by BN, so that a heating rate in a temperature range of 1000° C. to 1100° C. is preferably set to 15° C./h or less in a heating process of the finish annealing. Further, in place of controlling the heating rate, it is also effective to perform isothermal annealing in which the steel strip is maintained in the temperature range of 1000° C. to 1100° C. for 10 hours or longer.

According to this embodiment as above, it is possible to stably manufacture the grain-oriented electrical steel sheet excellent in the magnetic property.

Example

Next, experiments conducted by the present inventors will be explained. The conditions and so on in the experiments are examples employed for confirming the practicability and the effects of the present invention, and the present invention is not limited to those examples.

Fourth Experiment

In the fourth experiment, the effect of the B content in the case of no Se being contained was confirmed.

In the fourth experiment, first, slabs containing Si: 3.3 mass %, C: 0.06 mass %, acid-soluble Al: 0.028 mass %, N: 0.008 mass %, Mn: 0.1 mass %, S: 0.006 mass %, and B having an amount listed in Table 1 (0 mass % to 0.0045 mass %), and a balance being composed of Fe and inevitable impurities were manufactured. Next, the slabs were heated at 1100° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.023 mass %. Next, an annealing separating agent containing MgO as its main component was coated on the steel strips, and the steel strips were heated up to 1200° C. at a rate of 15° C./h and were finish annealed. Then, a magnetic property (the magnetic flux density B8) after the finish annealing was measured. The magnetic property (magnetic flux density B8) was measured based on JIS C2556. A result of the measurement is listed in Table 1.

TABLE 1

| | No. | B CONTENT (MASS %) | SLAB HEATING: HEATING TEMPERATURE (° C.) | SLAB HEATING: T1 (° C.) | SLAB HEATING: T3 (° C.) | NITRIDING TREATMENT: N CONTENT (MASS %) | PRECIPITATES: $B_{asBN}$ (MASS %) | PRECIPITATES: $[B]-B_{asBN}$ (MASS %) | PRECIPITATES: $S_{asMnS}$ (MASS %) | MAGNETIC PROPERTY: MAGNETIC FLUX DENSITY B8 (T) |
|---|---|---|---|---|---|---|---|---|---|---|
| COMPARATIVE EXAMPLE | 1A | 0 | 1100 | 1206 | — | 0.023 | 0 | 0 | 0.005 | 1.898 |
| EXAMPLE | 1B | 0.0008 | 1100 | 1206 | 1167 | 0.023 | 0.0008 | 0 | 0.005 | 1.917 |
| | 1C | 0.0019 | 1100 | 1206 | 1217 | 0.023 | 0.0018 | 0 | 0.005 | 1.929 |
| | 1D | 0.0031 | 1100 | 1206 | 1247 | 0.023 | 0.0030 | 0.0001 | 0.005 | 1.928 |
| | 1E | 0.0045 | 1100 | 1206 | 1271 | 0.023 | 0.0043 | 0.0002 | 0.005 | 1.923 |

As listed in Table 1, in Comparative Example No. 1A having no B contained in the slab, the magnetic flux density was low, but in Examples No. 1B to No. 1E each having an appropriate amount of B contained in the slab, the good magnetic flux density was obtained.

TABLE 2

| | No. | B CONTENT (MASS %) | SLAB HEATING: HEATING TEMPERATURE (° C.) | SLAB HEATING: T1 (° C.) | SLAB HEATING: T3 (° C.) | NITRIDING TREATMENT: N CONTENT (MASS %) | PRECIPITATES: $B_{asBN}$ (MASS %) | PRECIPITATES: $[B]-B_{asBN}$ (MASS %) | PRECIPITATES: $S_{asMnS}$ (MASS %) | MAGNETIC PROPERTY: MAGNETIC FLUX DENSITY B8 (T) |
|---|---|---|---|---|---|---|---|---|---|---|
| COMPARATIVE EXAMPLE | 2A | 0 | 1180 | 1206 | — | 0.023 | 0 | 0 | 0.025 | 1.893 |
| | 2B | 0.0008 | 1180 | 1206 | 1167 | 0.023 | 0.0002 | 0.0006 | 0.025 | 1.634 |
| EXAMPLE | 2C | 0.0019 | 1180 | 1206 | 1217 | 0.023 | 0.0012 | 0.0007 | 0.025 | 1.922 |
| | 2D | 0.0031 | 1180 | 1206 | 1247 | 0.023 | 0.0024 | 0.0007 | 0.025 | 1.927 |
| | 2E | 0.0045 | 1180 | 1206 | 1271 | 0.023 | 0.0036 | 0.0009 | 0.025 | 1.920 |

Fifth Experiment

In the fifth experiment, the effects of the B content and the slab heating temperature in the case of no Se being contained were confirmed.

In the fifth experiment, first, slabs containing Si: 3.3 mass %, C: 0.06 mass %, acid-soluble Al: 0.028 mass %, N: 0.008 mass %, Mn: 0.1 mass %, S: 0.006 mass %, Cr: 0.1 mass %, P: 0.03 mass %, Sn: 0.06 mass %, and B having an amount listed in Table 2 (0 mass % to 0.0045 mass %), and a balance being composed of Fe and inevitable impurities were manufactured. Next, the slabs were heated at 1180° C., and thereafter were subjected to finish rolling at 950° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.023 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 2.

As listed in Table 2, in Comparative Example No. 2A having no B contained in the slab and Comparative Example No. 2B having the slab heating temperature higher than the temperature T3, the magnetic flux density was low. On the other hand, in Examples No. 2C to No. 2E each having an appropriate amount of B contained in the slab and having the slab heating temperature being the temperature T1 or lower and the temperature T3 or lower, the good magnetic flux density was obtained.

Sixth Experiment

In the sixth experiment, the effects of the Mn content and the slab heating temperature in the case of no Se being contained were confirmed.

In the sixth experiment, first, slabs containing Si: 3.3 mass %, C: 0.06 mass %, acid-soluble Al: 0.028 mass %, N: 0.009 mass %, S: 0.007 mass %, B: 0.002 mass %, and Mn having an amount listed in Table (0.05 mass % to 0.20 mass %), and a balance being composed of Fe and inevitable impurities were manufactured. Next, the slabs were heated at 1200° C., and thereafter were subjected to finish rolling at 950° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.022 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 3.

TABLE 3

| | | | SLAB HEATING | | | | | | | MAGNETIC PROPERTY |
|---|---|---|---|---|---|---|---|---|---|---|
| | | | HEATING TEMPER- | | | NITRIDING TREATMENT | PRECIPITATES | | | MAGNETIC FLUX |
| | No. | Mn CONTENT (MASS %) | ATURE (° C.) | T1 (° C.) | T3 (° C.) | N CONTENT (MASS %) | $B_{asBN}$ (MASS %) | $[B] - B_{asBN}$ (MASS %) | $S_{asMnS}$ (MASS %) | DENSITY B8 (T) |
| COMPAR-ATIVE EXAMPLE | 3A | 0.05 | 1200 | 1173 | 1227 | 0.022 | 0.0012 | 0.0008 | 0.001 | 1.824 |
| EXAMPLE | 3B | 0.10 | 1200 | 1216 | 1227 | 0.022 | 0.0014 | 0.0006 | 0.002 | 1.923 |
| | 3C | 0.14 | 1200 | 1238 | 1227 | 0.022 | 0.0015 | 0.0005 | 0.004 | 1.931 |
| | 3D | 0.20 | 1200 | 1263 | 1227 | 0.022 | 0.0016 | 0.0004 | 0.005 | 1.925 |

As listed in Table 3, in Comparative Example No. 3A having the slab heating temperature higher than the temperature T1, the magnetic flux density was low. On the other hand, in Examples No. 3B to No. 3D each having the slab heating temperature being the temperature T1 or lower and the temperature T3 or lower, the good magnetic flux density was obtained.

Seventh Experiment

In the seventh experiment, the effect of the finish temperature Tf of the finish rolling in the hot rolling in the case of no Se being contained was confirmed.

In the seventh experiment, first, slabs containing Si: 3.3 mass %, C: 0.06 mass %, acid-soluble Al: 0.028 mass %, N: 0.008 mass %, Mn: 0.1 mass %, S: 0.006 mass %, and B: 0.002 mass %, and a balance being composed of Fe and inevitable impurities were manufactured. Next, the slabs were heated at 1180° C., and thereafter were subjected to finish rolling at the finish temperature Tf listed in Table 4 (800° C. to 1000° C.). In this manner, hot-rolled steel strips each having a thickness of 2 3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.020 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 4.

TABLE 4

| | | SLAB HEATING | | | FINISH ROLLING | | | | | | MAGNETIC PROPERTY |
|---|---|---|---|---|---|---|---|---|---|---|---|
| | | HEATING TEMPER- | | | FINISH TEMPER- | RIGHT SIDE OF | NITRIDING TREATMENT | PRECIPITATES | | | MAGNETIC FLUX |
| | No. | ATURE (° C.) | T1 (° C.) | T3 (° C.) | ATURE Tf (° C.) | EXPRES-SION (4) | N CONTENT (MASS %) | $B_{asBN}$ (MASS %) | $[B] - B_{asBN}$ (MASS %) | $S_{asMnS}$ (MASS %) | DENSITY B8 (T) |
| EXAMPLE | 4A | 1180 | 1206 | 1220 | 800 | 980 | 0.020 | 0.0015 | 0.0005 | 0.003 | 1.929 |
| | 4B | 1180 | 1206 | 1220 | 850 | 980 | 0.020 | 0.0013 | 0.0007 | 0.003 | 1.927 |
| | 4C | 1180 | 1206 | 1220 | 900 | 980 | 0.020 | 0.0012 | 0.0006 | 0.002 | 1.924 |
| COMPAR-ATIVE EXAMPLE | 4D | 1180 | 1206 | 1220 | 1000 | 980 | 0.020 | 0.0011 | 0.0009 | 0.002 | 1.895 |

In the case of the B content being 0.002 mass % (20 ppm), the finish temperature Tf is necessary to be 980° C. or lower based on inequation (4). Then, as listed in Table 4, in Examples No. 4A to 4C each satisfying the condition, the good magnetic flux density was obtained, but in Comparative Example No. 4D not satisfying the condition, the magnetic flux density was low.

Eighth Experiment

In the eighth experiment, the effect of the N content after the nitriding treatment in the case of no Se being contained was confirmed.

In the eighth experiment, first, slabs containing Si: 3.3 mass %, C: 0.06 mass %, acid-soluble Al: 0.028 mass %, N: 0.008 mass %, Mn: 0.1 mass %, S: 0.006 mass %, and B: 0.002 mass %, a content of Ti that is an impurity being 0.0014 mass %, and a balance being composed of Fe and inevitable impurities were manufactured. Next, the slabs were heated at 1150° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to an amount listed in Table 5 (0.012 mass % to 0.028 mass %). Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 5.

As listed in Table 5, in Examples No. 5C and No. 5D in which an N content after the nitriding treatment satisfied the relation of inequation (8) and the relation of inequation (9), the particularly good magnetic flux density was obtained. On the other hand, in Examples No. 5A and No. 5B in which an N content after the nitriding treatment did not satisfy the relation of inequation (8) and the relation of inequation (9), the magnetic flux density was slightly lower than those in Examples No. 5C and No. 5D.

Ninth Experiment

In the ninth experiment, the effect of the condition of the finish annealing in the case of no Se being contained was confirmed.

In the ninth experiment, first, slabs containing Si: 3.3 mass %, C: 0.06 mass %, acid-soluble Al: 0.028 mass %, N: 0.008 mass %, Mn: 0.1 mass %, S: 0.006 mass %, and B: 0.002 mass %, and a balance being composed of Fe and inevitable impurities were manufactured. Next, the slabs were heated at 1150° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.024 mass %. Next, an annealing separating agent containing MgO as its main component was coated on the steel strips, and the steel strips were heated up to 1000° C. at a rate of 15° C./h, and further were heated up to 1200° C. at a rate listed in Table 6 (5° C./h to 30° C./h) and were finish annealed. Then, similarly to the fourth experiment, a magnetic property (the magnetic flux density B8) was measured. A result of the measurement is listed in Table 6.

TABLE 5

| | | SLAB HEATING | | | FINISH ROLLING | | NITRIDING TREATMENT | |
|---|---|---|---|---|---|---|---|---|
| | No. | HEATING TEMPERATURE (° C.) | T1 (° C.) | T3 (° C.) | FINISH TEMPERATURE Tf (° C.) | RIGHT SIDE OF EXPRESSION (4) | N CONTENT (MASS %) | RIGHT SIDE OF EXPRESSION (8) |
| EXAMPLE | 5A | 1150 | 1206 | 1220 | 900 | 980 | 0.012 | 0.018 |
| | 5B | 1150 | 1206 | 1220 | 900 | 980 | 0.017 | 0.018 |
| | 5C | 1150 | 1206 | 1220 | 900 | 980 | 0.022 | 0.018 |
| | 5D | 1150 | 1206 | 1220 | 900 | 980 | 0.028 | 0.018 |

| | | NITRIDING TREATMENT RIGHT SIDE OF EXPRESSION (9) | PRECIPITATES | | | MAGNETIC PROPERTY MAGNETIC FLUX DENSITY B8 (T) |
|---|---|---|---|---|---|---|
| | No. | | $B_{asBN}$ (MASS %) | $[B] - B_{asBN}$ (MASS %) | $S_{asMnS}$ (MASS %) | |
| EXAMPLE | 5A | 0.022 | 0.0017 | 0.0003 | 0.005 | 1.888 |
| | 5B | 0.022 | 0.0017 | 0.0003 | 0.005 | 1.905 |
| | 5C | 0.022 | 0.0017 | 0.0003 | 0.005 | 1.925 |
| | 5D | 0.022 | 0.0017 | 0.0003 | 0.005 | 1.927 |

TABLE 6

| | | FINISH ANNEALING | SLAB HEATING | | | FINISH ROLLING | | NITRIDING TREATMENT |
|---|---|---|---|---|---|---|---|---|
| | No. | HEATING SPEED (° C./h) | HEATING TEMPERATURE (° C.) | T1 (° C.) | T3 (° C.) | FINISH TEMPERATURE Tf (° C.) | RIGHT SIDE OF EXPRESSION (4) | N CONTENT (MASS %) |
| EXAMPLE | 6A | 5 | 1150 | 1206 | 1220 | 900 | 980 | 0.024 |
| | 6B | 10 | 1150 | 1206 | 1220 | 900 | 980 | 0.024 |
| | 6C | 15 | 1150 | 1206 | 1220 | 900 | 980 | 0.024 |
| | 6D | 30 | 1150 | 1206 | 1220 | 900 | 980 | 0.024 |

| | | NITRIDING TREATMENT | | PRECIPITATES | | | MAGNETIC PROPERTY |
|---|---|---|---|---|---|---|---|
| | No. | RIGHT SIDE OF EXPRESSION (8) | RIGHT SIDE OF EXPRESSION (9) | $B_{asBN}$ (MASS %) | $[B] - B_{asBN}$ (MASS %) | $S_{asMnS}$ (MASS %) | MAGNETIC FLUX DENSITY B8 (T) |
| EXAMPLE | 6A | 0.017 | 0.021 | 0.0017 | 0.0003 | 0.005 | 1.933 |
| | 6B | 0.017 | 0.021 | 0.0017 | 0.0003 | 0.005 | 1.927 |
| | 6C | 0.017 | 0.021 | 0.0017 | 0.0003 | 0.005 | 1.924 |
| | 6D | 0.017 | 0.021 | 0.0017 | 0.0003 | 0.005 | 1.893 |

As listed in Table 6, in Examples No. 6A to No. 6C, the heating rate in a temperature range of 1000° C. to 1100° C. was set to 15° C./h or less, so that the particularly good magnetic flux density was obtained. On the other hand, in Example No. 6D, the heating rate in the temperature range exceeded 15° C./h, so that the magnetic flux density was slightly lower than those in Examples No. 6A to No. 6C.

Tenth Experiment

In the tenth experiment, the effect of the condition of the finish annealing in the case of no Se being contained was confirmed.

In the tenth experiment, first, slabs containing Si: 3.3 mass %, C: 0.06 mass %, acid-soluble Al: 0.028 mass %, N: 0.008 mass %, Mn: 0.1 mass %, S: 0.006 mass %, and B: 0.002 mass %, and a balance being composed of Fe and inevitable impurities were manufactured. Next, the slabs were heated at 1150° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.024 mass %. Next, an annealing separating agent containing MgO as its main component was coated on the steel strips. Then, in Example No. 7A, the steel strip was heated up to 1200° C. at a rate of 15° C./h and was finish annealed. Further, in Examples No. 7B to No. 7E, the steel strips were heated up to a temperature listed in Table 7 (1000° C. to 1150° C.) at a rate of 30° C./h and were kept for 10 hours at the temperature, and thereafter were heated up to 1200° C. at a rate of 30° C./h and were finish annealed. Then, similarly to the fourth experiment, a magnetic property (the magnetic flux density B8) was measured. A result of the measurement is listed in Table V.

TABLE 7

| | | FINISH ANNEALING | SLAB HEATING | | | FINISH ROLLING | | NITRIDING TREATMENT |
|---|---|---|---|---|---|---|---|---|
| | No. | MAINTAINING TEMPERATURE (° C.) | HEATING TEMPERATURE (° C.) | T1 (° C.) | T3 (° C.) | FINISH TEMPERATURE Tf (° C.) | RIGHT SIDE OF EXPRESSION (4) | N CONTENT (MASS %) |
| EXAMPLE | 7A | — | 1150 | 1206 | 1220 | 900 | 980 | 0.024 |
| | 7B | 1000 | 1150 | 1206 | 1220 | 900 | 980 | 0.024 |
| | 7C | 1050 | 1150 | 1206 | 1220 | 900 | 980 | 0.024 |
| | 7D | 1100 | 1150 | 1206 | 1220 | 900 | 980 | 0.024 |
| | 7E | 1150 | 1150 | 1206 | 1220 | 900 | 980 | 0.024 |

TABLE 7-continued

| | No. | NITRIDING TREATMENT RIGHT SIDE OF EXPRESSION (8) | NITRIDING TREATMENT RIGHT SIDE OF EXPRESSION (9) | PRECIPITATES $B_{asBN}$ (MASS %) | PRECIPITATES [B] − $B_{asBN}$ (MASS %) | PRECIPITATES $S_{asMnS}$ (MASS %) | MAGNETIC PROPERTY MAGNETIC FLUX DENSITY B8 (T) |
|---|---|---|---|---|---|---|---|
| EXAMPLE | 7A | 0.017 | 0.021 | 0.0017 | 0.0003 | 0.005 | 1.908 |
| | 7B | 0.017 | 0.021 | 0.0017 | 0.0003 | 0.005 | 1.928 |
| | 7C | 0.017 | 0.021 | 0.0017 | 0.0003 | 0.005 | 1.931 |
| | 7D | 0.017 | 0.021 | 0.0017 | 0.0003 | 0.005 | 1.927 |
| | 7E | 0.017 | 0.021 | 0.0017 | 0.0003 | 0.005 | 1.881 |

As listed in Table 7, in Example No. 7A, the heating rate in a temperature range of 1000° C. to 1100° C. was set to 15° C./h or less, so that the particularly good magnetic flux density was obtained. Further, in Examples No. 7B to 7D, the steel strips were kept in the temperature range of 1000° C. to 1100° C. for 10 hours, so that the particularly good magnetic flux density was obtained. On the other hand, in Example No. 7E, the temperature at which the steel strip was kept for 10 hours exceeded 1100° C., so that the magnetic flux density was slightly lower than those in Examples No. 7A to No. 7D.

Eleventh Experiment

In the eleventh experiment, the effect of the slab heating temperature in the case of no Se being contained was confirmed.

In the eleventh experiment, first, slabs containing Si: 3.3 mass %, C: 0.06 mass %, acid-soluble Al: 0.028 mass %, N: 0.008 mass %, Mn: 0.1 mass %, S: 0.006 mass %, and B: 0.0017 mass %, and a balance being composed of Fe and inevitable impurities were manufactured. Next, the slabs were heated at a temperature listed in Table 8 (1100° C. to 1300° C.), and thereafter were subjected to finish rolling at 950° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.021 mass %. Next, an annealing separating agent containing MgO as its main component was coated on the steel strips, and the steel strips were heated up to 1200° C. at a rate of 15° C./h, and were finish annealed. Then, similarly to the fourth experiment, a magnetic property (the magnetic flux density B8) was measured. A result of the measurement is listed in Table 8.

TABLE 8

| | No. | SLAB HEATING HEATING TEMPERATURE (° C.) | SLAB HEATING T1 (° C.) | SLAB HEATING T3 (° C.) | NITRIDING TREATMENT N CONTENT (MASS %) | PRECIPITATES $B_{asBN}$ (MASS %) | PRECIPITATES [B] − $B_{asBN}$ (MASS %) | PRECIPITATES $S_{asMnS}$ (MASS %) | MAGNETIC PROPERTY MAGNETIC FLUX DENSITY B8 (T) |
|---|---|---|---|---|---|---|---|---|---|
| EXAMPLE | 8A | 1100 | 1206 | 1210 | 0.021 | 0.0016 | 0.0001 | 0.006 | 1.926 |
| | 8B | 1150 | 1206 | 1210 | 0.021 | 0.0013 | 0.0004 | 0.005 | 1.925 |
| | 8C | 1200 | 1206 | 1210 | 0.021 | 0.0011 | 0.0006 | 0.002 | 1.903 |
| COMPARATIVE | 8D | 1250 | 1206 | 1210 | 0.021 | 0.0005 | 0.0012 | 0.001 | 1.773 |
| EXAMPLE | 8E | 1300 | 1206 | 1210 | 0.021 | 0.0002 | 0.0015 | 0.001 | 1.623 |

As listed in Table 8, in Examples No. 8A to No. 8C each having the slab heating temperature being the temperature T1 or lower and the temperature T3 or lower, the good magnetic flux density was obtained. On the other hand, in Comparative Examples No. 8D and No. 8E each having the slab heating temperature higher than the temperature T1 and the temperature T3, the magnetic flux density was low.

Twelfth Experiment

In the twelfth experiment, the effect of the components of the slab in the case of no Se being contained was confirmed.

In the twelfth experiment, first, slabs containing components listed in Table 9 and a balance being composed of Fe and inevitable impurities were manufactured. Next, the slabs were heated at 1100° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.022 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 10.

TABLE 9

| | No. | COMPOSITION OF SILICON STEEL MATERIAL (MASS %) | | | | | | | | | | | | | | |
|---|---|---|---|---|---|---|---|---|---|---|---|---|---|---|---|---|
| | | Si | C | Al | N | Mn | S | B | Cr | Cu | Ni | P | Mo | Sn | Sb | Bi |
| EXAMPLE | 9A | 3.3 | 0.06 | 0.028 | 0.008 | 0.1 | 0.006 | 0.002 | — | — | — | — | — | — | — | — |
| | 9B | 3.2 | 0.06 | 0.027 | 0.007 | 0.1 | 0.007 | 0.002 | 0.15 | — | — | — | — | — | — | — |
| | 9C | 3.4 | 0.06 | 0.025 | 0.008 | 0.1 | 0.008 | 0.002 | — | 0.2 | — | — | — | — | — | — |
| | 9D | 3.3 | 0.06 | 0.027 | 0.008 | 0.1 | 0.006 | 0.002 | — | — | 0.1 | — | — | — | — | — |
| | 9E | 3.3 | 0.06 | 0.024 | 0.007 | 0.1 | 0.006 | 0.002 | — | — | 0.4 | — | — | — | — | — |
| | 9F | 3.3 | 0.06 | 0.027 | 0.009 | 0.1 | 0.007 | 0.002 | — | — | 1.0 | — | — | — | — | — |
| | 9G | 3.4 | 0.06 | 0.028 | 0.007 | 0.1 | 0.007 | 0.002 | — | — | — | 0.03 | — | — | — | — |
| | 9H | 3.2 | 0.06 | 0.027 | 0.008 | 0.1 | 0.006 | 0.002 | — | — | — | — | 0.005 | — | — | — |
| | 9I | 3.3 | 0.06 | 0.028 | 0.008 | 0.1 | 0.007 | 0.002 | — | — | — | — | — | 0.04 | — | — |
| | 9J | 3.3 | 0.06 | 0.025 | 0.008 | 0.1 | 0.006 | 0.002 | — | — | — | — | — | — | 0.04 | — |
| | 9K | 3.3 | 0.06 | 0.024 | 0.009 | 0.1 | 0.008 | 0.002 | — | — | — | — | — | — | — | 0.003 |
| | 9L | 3.2 | 0.06 | 0.030 | 0.008 | 0.1 | 0.006 | 0.002 | 0.10 | — | — | 0.03 | — | 0.06 | — | — |
| | 9M | 3.8 | 0.06 | 0.027 | 0.008 | 0.1 | 0.007 | 0.002 | 0.05 | 0.15 | 0.1 | 0.02 | — | 0.04 | — | — |
| | 9N | 3.3 | 0.06 | 0.028 | 0.006 | 0.1 | 0.006 | 0.002 | 0.08 | — | — | — | 0.003 | 0.05 | — | 0.001 |
| | 9O | 2.8 | 0.06 | 0.022 | 0.008 | 0.1 | 0.006 | 0.002 | — | — | — | — | — | — | — | — |
| COMPARATIVE EXAMPLE | 9P | 3.3 | 0.06 | 0.035 | 0.007 | 0.1 | 0.002 | 0.002 | — | — | — | — | — | — | — | — |

TABLE 10

| | No. | PRECIPITATES | | | MAGNETIC PROPERTY |
|---|---|---|---|---|---|
| | | $B_{asBN}$ (MASS %) | $[B] - B_{asBN}$ (MASS %) | $S_{asMnS}$ (MASS %) | MAGNETIC FLUX DENSITY B8 (T) |
| EXAMPLE | 9A | 0.0018 | 0.0002 | 0.005 | 1.923 |
| | 9B | 0.0019 | 0.0001 | 0.006 | 1.924 |
| | 9C | 0.0019 | 0.0001 | 0.007 | 1.929 |
| | 9D | 0.0018 | 0.0002 | 0.005 | 1.925 |
| | 9E | 0.0019 | 0.0001 | 0.005 | 1.920 |
| | 9F | 0.0019 | 0.0001 | 0.006 | 1.881 |
| | 9G | 0.0018 | 0.0002 | 0.006 | 1.929 |
| | 9H | 0.0019 | 0.0001 | 0.005 | 1.925 |
| | 9I | 0.0018 | 0.0002 | 0.007 | 1.926 |
| | 9J | 0.0019 | 0.0001 | 0.005 | 1.924 |
| | 9K | 0.0019 | 0.0001 | 0.007 | 1.928 |
| | 9L | 0.0018 | 0.0002 | 0.005 | 1.929 |
| | 9M | 0.0019 | 0.0001 | 0.006 | 1.928 |
| | 9N | 0.0018 | 0.0002 | 0.005 | 1.926 |
| | 9O | 0.0018 | 0.0002 | 0.005 | 1.938 |
| COMPARATIVE EXAMPLE | 9P | 0.0018 | 0.0002 | 0.001 | 1.621 |

As listed in Table 10, in Examples No. 9A to No. 9O each using the slab having the appropriate composition, the good magnetic flux density was obtained, but in Comparative Example No. 9P having an S content being less than the lower limit of the present invention range, the magnetic flux density was low.

Thirteenth Experiment

In the thirteenth experiment, the effect of the nitriding treatment in the case of no Se being contained was confirmed.

In the thirteenth experiment, first, slabs containing Si: 3.3 mass %, C: 0.06 mass %, acid-soluble Al: 0.027 mass %, N: 0.007 mass %, Mn: 0.14 mass %, S: 0.006 mass %, and B: 0.0015 mass %, and a balance being composed of Fe and inevitable impurities were manufactured. Next, the slabs were heated at 1150° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained.

Thereafter, as for a sample of Comparative Example No. 10A, decarburization annealing was performed in a moist atmosphere gas at 830° C. for 100 seconds, and thereby a decarburization-annealed steel strip was obtained. Further, as for a sample of Example No. 10B, decarburization annealing was performed in a moist atmosphere gas at 830° C. for 100 seconds, and further annealing was performed in an ammonia containing atmosphere, and thereby a decarburization-annealed steel strip having an N content of 0.021 mass % was obtained. Further, as for a sample of Example No. 10C, decarburization annealing was performed in a moist atmosphere gas at 860° C. for 100 seconds, and thereby a decarburization-annealed steel strip having an N content of 0.021 mass % was obtained. In this manner, three types of the decarburization-annealed steel strips were obtained.

Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 11.

TABLE 11

| | No. | APPLICATION OR NO APPLICATION OF NITRIDING TREATMENT | SLAB HEATING HEATING TEMPERATURE (° C.) | T1 (° C.) | T3 (° C.) | NITRIDING TREATMENT N CONTENT (MASS %) | RIGHT SIDE OF EXPRESSION (3) |
|---|---|---|---|---|---|---|---|
| COMPARATIVE EXAMPLE | 10A | NOT APPLIED | 1150 | 1228 | 1195 | 0.007 | 0.016 |
| EXAMPLE | 10B | APPLIED | 1150 | 1228 | 1195 | 0.021 | 0.016 |
| | 10C | APPLIED | 1150 | 1228 | 1195 | 0.021 | 0.016 |

| | No. | NITRIDING TREATMENT RIGHT SIDE OF EXPRESSION (4) | PRECIPITATES $B_{asBN}$ (MASS %) | [B] − $B_{asBN}$ (MASS %) | $S_{asMnS}$ (MASS %) | MAGNETIC PROPERTY MAGNETIC FLUX DENSITY B8 (T) |
|---|---|---|---|---|---|---|
| COMPARATIVE EXAMPLE | 10A | 0.020 | 0.0013 | 0.0002 | 0.005 | 1.564 |
| EXAMPLE | 10B | 0.020 | 0.0013 | 0.0002 | 0.005 | 1.927 |
| | 10C | 0.020 | 0.0013 | 0.0002 | 0.005 | 1.925 |

As listed in Table 11, in Example No. 10B in which the nitriding treatment was performed after the decarburization annealing, and Example No. 10C in which the nitriding treatment was performed during the decarburization annealing, the good magnetic flux density was obtained. However, in Comparative Example No. 10A in which no nitriding treatment was performed, the magnetic flux density was low. Incidentally, the numerical value in the section of "NITRIDING TREATMENT" of Comparative Example No. 10A in Table 11 is a value obtained from the composition of the decarburization-annealed steel strip.

Fourteenth Experiment

In the fourteenth experiment, the effect of the B content in the case of no S being contained was confirmed.

In the fourteenth experiment, first, slabs containing Si: 3.2 mass %, C: 0.06 mass %, acid-soluble Al: 0.027 mass %, N: 0.008 mass %, Mn: 0.12 mass %, Se: 0.008 mass %, and B having an amount listed in Table (0 mass % to 0.0043 mass %), and a balance being composed of Fe and inevitable impurities were manufactured. Next, the slabs were heated at 1100° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.024 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 12.

TABLE 12

| | No. | B CONTENT (MASS %) | SLAB HEATING HEATING TEMPERATURE (° C.) | T2 (° C.) | T3 (° C.) | NITRIDING TREATMENT N CONTENT (MASS %) | PRECIPITATES $B_{asBN}$ (MASS %) | [B] − $B_{asBN}$ (MASS %) | $Se_{asMnSe}$ (MASS %) | MAGNETIC PROPERTY MAGNETIC FLUX DENSITY B8 (T) |
|---|---|---|---|---|---|---|---|---|---|---|
| COMPARATIVE EXAMPLE | 11A | 0 | 1100 | 1239 | — | 0.024 | 0 | 0 | 0.0069 | 1.895 |
| EXAMPLE | 11B | 0.0009 | 1100 | 1239 | 1173 | 0.024 | 0.0007 | 0.0002 | 0.0068 | 1.919 |
| | 11C | 0.0017 | 1100 | 1239 | 1210 | 0.024 | 0.0015 | 0.0002 | 0.0070 | 1.928 |
| | 11D | 0.0029 | 1100 | 1239 | 1243 | 0.024 | 0.0026 | 0.0003 | 0.0069 | 1.925 |
| | 11E | 0.0043 | 1100 | 1239 | 1268 | 0.024 | 0.0038 | 0.0005 | 0.0071 | 1.926 |

As listed in Table 12, in Comparative Example No. 11A having no B contained in the slab, the magnetic flux density was low, but in Examples No. 11B to No. 11E each having an appropriate amount of B contained in the slab, the good magnetic flux density was obtained.

Fifteenth Experiment

In the fifteenth experiment, the effects of the B content and the slab heating temperature in the case of no S being contained were confirmed.

In the fifteenth experiment, first, slabs containing Si: 3.2 mass %, C: 0.06 mass %, acid-soluble Al: 0.027 mass %, N: 0.008 mass %, Mn: 0.12 mass %, Se: 0.008 mass %, and B having an amount listed in Table (0 mass % to 0.0043 mass %), and a balance being composed of Fe and inevitable impurities were manufactured. Next, the slabs were heated at 1180° C., and thereafter were subjected to finish rolling at 950° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.023 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 13.

TABLE 13

| | | | SLAB HEATING | | | NITRIDING | | | | MAGNETIC PROPERTY MAGNETIC |
|---|---|---|---|---|---|---|---|---|---|---|
| | | B | HEATING | | | TREATMENT | PRECIPITATES | | | FLUX |
| | No. | CONTENT (MASS %) | TEMPERATURE (° C.) | T2 (° C.) | T3 (° C.) | N CONTENT (MASS %) | $B_{asBN}$ (MASS %) | $[B]-B_{asBN}$ (MASS %) | $Se_{asMnSe}$ (MASS %) | DENSITY B8 (T) |
| COMPARATIVE EXAMPLE | 12A | 0 | 1180 | 1239 | — | 0.023 | 0 | 0 | 0.0042 | 1.892 |
| EXAMPLE | 12B | 0.0009 | 1180 | 1239 | 1173 | 0.023 | 0.0003 | 0.0006 | 0.0043 | 1.634 |
| | 12C | 0.0017 | 1180 | 1239 | 1210 | 0.023 | 0.0013 | 0.0004 | 0.0044 | 1.922 |
| | 12D | 0.0029 | 1180 | 1239 | 1243 | 0.023 | 0.0021 | 0.0008 | 0.0045 | 1.927 |
| | 12E | 0.0043 | 1180 | 1239 | 1268 | 0.023 | 0.0034 | 0.0009 | 0.0043 | 1.920 |

As listed in Table 13, in Comparative Example No. 12A having no B contained in the slab and Comparative Example No. 12B having the slab heating temperature higher than the temperature T3, the magnetic flux density was low. On the other hand, in Examples No. 12C to No. 12E each having an appropriate amount of B contained in the slab and having the slab heating temperature being the temperature T2 or lower and the temperature T3 or lower, the good magnetic flux density was obtained.

Sixteenth Experiment

In the sixteenth experiment, the effects of the Mn content and the slab heating temperature in the case of no S being contained were confirmed.

In the sixteenth experiment, first, slabs containing Si: 3.3 mass %, C: 0.06 mass %, acid-soluble Al: 0.028 mass %, N: 0.008 mass %, Se: 0.007 mass %, B: 0.0018 mass %, and Mn having an amount listed in Table (0.04 mass % to 0.2 mass %), and a balance being composed of Fe and inevitable impurities were manufactured. Next, the slabs were heated at 1150° C., and thereafter were subjected to finish rolling at 950° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and decarburization-annealed steel strips were obtained. Subsequently, the decarburization-annealed steel strips were annealed in an ammonia containing atmosphere to increase nitrogen in the steel strips up to 0.022 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 14.

TABLE 14

| | | | SLAB HEATING | | | NITRIDING | | | | MAGNETIC PROPERTY MAGNETIC |
|---|---|---|---|---|---|---|---|---|---|---|
| | | Mn | HEATING | | | TREATMENT | PRECIPITATES | | | FLUX |
| | No. | CONTENT (MASS %) | TEMPERATURE (° C.) | T2 (° C.) | T3 (° C.) | N CONTENT (MASS %) | $B_{asBN}$ (MASS %) | $[B]-B_{asBN}$ (MASS %) | $Se_{asMnSe}$ (MASS %) | DENSITY B8 (T) |
| COMPARATIVE EXAMPLE | 13A | 0.04 | 1150 | 1133 | 1214 | 0.022 | 0.0014 | 0.0004 | 0.0007 | 1.612 |
| EXAMPLE | 13B | 0.11 | 1150 | 1219 | 1214 | 0.022 | 0.0015 | 0.0003 | 0.0042 | 1.924 |
| | 13C | 0.15 | 1150 | 1248 | 1214 | 0.022 | 0.0014 | 0.0004 | 0.0051 | 1.929 |
| | 13D | 0.20 | 1150 | 1275 | 1214 | 0.022 | 0.0015 | 0.0003 | 0.0057 | 1.924 |

As listed in Table 14, in Comparative Example No. 13A having a Mn content being less than the lower limit of the present invention range, the magnetic flux density was low, but in Examples No. 13B to No. 13D each having an appropriate amount of Mn contained in the slab, the good magnetic flux density was obtained.

Seventeenth Experiment

In the seventeenth experiment, the effect of the finish temperature Tf of the finish rolling in the hot rolling in the case of no S being contained was confirmed.

In the seventeenth experiment, first, slabs containing Si: 3.3 mass %, C: 0.06 mass %, acid-soluble Al: 0.026 mass %, N: 0.008 mass %, Mn: 0.15 mass %, Se: 0.006 mass %, and B: 0.002 mass %, and a balance being composed of Fe and inevitable impurities were manufactured. Next, the slabs were heated at 1150° C., and thereafter were subjected to finish rolling at the finish temperature Tf listed in Table 15 (800° C. to 1000° C.). In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.020 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 15.

In the case of the B content being 0.002 mass % (20 ppm), the finish temperature Tf is necessary to be 980° C. or lower based on inequation (4). Then, as listed in Table 15, in Examples No. 14A to 14C each satisfying the condition, the good magnetic flux density was obtained, but in Comparative Example No. 14D not satisfying the condition, the magnetic flux density was low.

Eighteenth Experiment

In the eighteenth experiment, the effect of the N content after the nitriding treatment in the case of no S being contained was confirmed.

In the eighteenth experiment, first, slabs containing Si: 3.3 mass %, C: 0.06 mass %, acid-soluble Al: 0.027 mass %, N: 0.008 mass %, Mn: 0.12 mass %, Se: 0.007 mass %, and B: 0.0016 mass %, a content of Ti that is an impurity being 0.0013 mass %, and a balance being composed of Fe and inevitable impurities were manufactured. Next, the slabs were heated at 1100° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to an amount listed in Table 16 (0.011 mass % to 0.029 mass %). Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 16.

TABLE 15

| | | SLAB HEATING | | | FINISH ROLLING | |
|---|---|---|---|---|---|---|
| | No. | HEATING TEMPERATURE (° C.) | T2 (° C.) | T3 (° C.) | FINISH TEMPERATURE Tf (° C.) | RIGHT SIDE OF EXPRESSION (4) |
| EXAMPLE | 14A | 1150 | 1233 | 1220 | 800 | 980 |
| | 14B | 1150 | 1233 | 1220 | 850 | 980 |
| | 14C | 1150 | 1233 | 1220 | 900 | 980 |
| COMPARATIVE EXAMPLE | 14D | 1150 | 1233 | 1220 | 1000 | 980 |

| | | NITRIDING TREATMENT N | PRECIPITATES | | | MAGNETIC PROPERTY MAGNETIC FLUX |
|---|---|---|---|---|---|---|
| | No. | CONTENT (MASS %) | $B_{asBN}$ (MASS %) | $[B] - B_{asBN}$ (MASS %) | $Se_{asMnSe}$ (MASS %) | DENSITY B8 (T) |
| EXAMPLE | 14A | 0.020 | 0.0018 | 0.0002 | 0.0045 | 1.920 |
| | 14B | 0.020 | 0.0017 | 0.0003 | 0.0044 | 1.923 |
| | 14C | 0.020 | 0.0017 | 0.0003 | 0.0044 | 1.922 |
| COMPARATIVE EXAMPLE | 14D | 0.020 | 0.0014 | 0.0006 | 0.0042 | 1.901 |

TABLE 16

| | | SLAB HEATING | | | FINISH ROLLING | | NITRIDING TREATMENT | |
|---|---|---|---|---|---|---|---|---|
| | No. | HEATING TEMPERATURE (° C.) | T2 (° C.) | T3 (° C.) | FINISH TEMPERATURE Tf (° C.) | RIGHT SIDE OF EXPRESSION (4) | N CONTENT (MASS %) | RIGHT SIDE OF EXPRESSION (8) |
| EXAMPLE | 15A | 1100 | 1227 | 1207 | 900 | 984 | 0.011 | 0.016 |
| | 15B | 1100 | 1227 | 1207 | 900 | 984 | 0.019 | 0.016 |
| | 15C | 1100 | 1227 | 1207 | 900 | 984 | 0.023 | 0.016 |
| | 15D | 1100 | 1227 | 1207 | 900 | 984 | 0.029 | 0.016 |

| | | NITRIDING TREATMENT RIGHT SIDE OF EXPRESSION (9) | PRECIPITATES | | | MAGNETIC PROPERTY MAGNETIC FLUX DENSITY B8 (T) |
|---|---|---|---|---|---|---|
| | No. | | $B_{asBN}$ (MASS %) | [B] − $B_{asBN}$ (MASS %) | $Se_{asMnSe}$ (MASS %) | |
| EXAMPLE | 15A | 0.020 | 0.0015 | 0.0001 | 0.0059 | 1.887 |
| | 15B | 0.020 | 0.0015 | 0.0001 | 0.0059 | 1.918 |
| | 15C | 0.020 | 0.0015 | 0.0001 | 0.0059 | 1.924 |
| | 15D | 0.020 | 0.0015 | 0.0001 | 0.0059 | 1.929 |

As listed in Table 16, in Examples No. 15C and No. 15D in which an N content after the nitriding treatment satisfied the relation of inequation (8) and the relation of inequation (9), the particularly good magnetic flux density was obtained. On the other hand, in Example No. 15B in which an N content after the nitriding treatment satisfied the relation of inequation (8) but did not satisfy the relation of inequation (9), the magnetic flux density was slightly lower than those in Examples No. 15C and No. 15D. Further, in Example No. 15A in which an N content after the nitriding treatment did not satisfy the relation of inequation (8) and the relation of inequation (9), the magnetic flux density was slightly lower than that in Example No. 15B.

Nineteenth Experiment

In the nineteenth experiment, the effect of the condition of the finish annealing in the case of no S being contained was confirmed.

In the nineteenth experiment, first, slabs containing Si: 3.3 mass %, C: 0.06 mass %, acid-soluble Al: 0.028 mass %, N: 0.008 mass %, Mn: 0.1 mass %, Se: 0.006 mass %, and B: 0.0022 mass %, and a balance being composed of Fe and inevitable impurities were manufactured. Next, the slabs were heated at 1100° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 840° C. for 100 seconds, and thereby decarburization-annealed steel strips were obtained. Subsequently, the decarburization-annealed steel strips were annealed in an ammonia containing atmosphere to increase nitrogen in the steel strips up to 0.024 mass %. Next, an annealing separating agent containing MgO as its main component was coated on the steel strips, and the steel strips were heated up to 1000° C. at a rate of 15° C./h, and further were heated up to 1200° C. at a rate listed in Table 17 (5° C./h to 30° C./h) and were finish annealed. Then, similarly to the fourth experiment, a magnetic property (the magnetic flux density B8) was measured. A result of the measurement is listed in Table 17.

TABLE 17

| | | FINISH ANNEALING | SLAB HEATING | | | FINISH ROLLING | | NITRIDING TREATMENT |
|---|---|---|---|---|---|---|---|---|
| | No. | HEATING SPEED (° C./h) | HEATING TEMPERATURE (° C.) | T2 (° C.) | T3 (° C.) | FINISH TEMPERATURE Tf (° C.) | RIGHT SIDE OF EXPRESSION (4) | N CONTENT (MASS %) |
| EXAMPLE | 16A | 5 | 1100 | 1197 | 1226 | 900 | 978 | 0.024 |
| | 16B | 10 | 1100 | 1197 | 1226 | 900 | 978 | 0.024 |
| | 16C | 15 | 1100 | 1197 | 1226 | 900 | 978 | 0.024 |
| | 16D | 30 | 1100 | 1197 | 1226 | 900 | 978 | 0.024 |

| | | NITRIDING TREATMENT | | PRECIPITATES | | | MAGNETIC PROPERTY MAGNETIC FLUX DENSITY B8 (T) |
|---|---|---|---|---|---|---|---|
| | No. | RIGHT SIDE OF EXPRESSION (8) | RIGHT SIDE OF EXPRESSION (9) | $B_{asBN}$ (MASS %) | [B] − $B_{asBN}$ (MASS %) | $Se_{asMnSe}$ (MASS %) | |
| EXAMPLE | 16A | 0.017 | 0.022 | 0.0020 | 0.0002 | 0.0047 | 1.935 |
| | 16B | 0.017 | 0.022 | 0.0020 | 0.0002 | 0.0047 | 1.928 |

TABLE 17-continued

| | | | | | | |
|---|---|---|---|---|---|---|
| 16C | 0.017 | 0.022 | 0.0020 | 0.0002 | 0.0047 | 1.922 |
| 16D | 0.017 | 0.022 | 0.0020 | 0.0002 | 0.0047 | 1.882 |

As listed in Table 17, in Examples No. 16A to No. 16C, the heating rate in a temperature range of 1000° C. to 1100° C. was set to 15° C./h or less, so that the particularly good magnetic flux density was obtained. On the other hand, in Example No. 16D, the heating rate in the temperature range exceeded 15° C./h, so that the magnetic flux density was slightly lower than those in Examples No. 16A to No. 16C.

Twentieth Experiment

In the twentieth experiment, the effect of the condition of the finish annealing in the case of no S being contained was confirmed.

In the twentieth experiment, first, slabs containing Si: 3.3 mass %, C: 0.06 mass %, acid-soluble Al: 0.028 mass %, N: 0.008 mass %, Mn: 0.1 mass %, Se: 0.006 mass %, and B: 0.0022 mass %, and a balance being composed of Fe and inevitable impurities were manufactured. Next, the slabs were heated at 1100° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 840° C. for 100 seconds, and thereby decarburization-annealed steel strips were obtained. Subsequently, the decarburization-annealed steel strips were annealed in an ammonia containing atmosphere to increase nitrogen in the steel strips up to 0.024 mass %. Next, an annealing separating agent containing MgO as its main component was coated on the steel strips. Then, in Example No. 17A, the steel strip was heated up to 1200° C. at a rate of 15° C./h and was finish annealed. Further, in Examples No. 17B to No. 17E, the steel strips were heated up to a temperature listed in Table 18 (1000° C. to 1150° C.) at a rate of 30° C./h and were kept for 10 hours at the temperature, and thereafter were heated up to 1200° C. at a rate of 30° C./h and were finish annealed. Then, similarly to the fourth experiment, a magnetic property (the magnetic flux density B8) was measured. A result of the measurement is listed in Table 18.

TABLE 18

| | | FINISH ANNEALING | SLAB HEATING | | | FINISH ROLLING | | NITRIDING |
|---|---|---|---|---|---|---|---|---|
| | No. | MAINTAINING TEMPERATURE (° C.) | HEATING TEMPERATURE (° C.) | T2 (° C.) | T3 (° C.) | FINISH TEMPERATURE Tf (° C.) | RIGHT SIDE OF EXPRESSION (4) | TREATMENT N CONTENT (MASS %) |
| EXAMPLE | 17A | — | 1100 | 1197 | 1226 | 900 | 978 | 0.024 |
| | 17B | 1000 | 1100 | 1197 | 1226 | 900 | 978 | 0.024 |
| | 17C | 1050 | 1100 | 1197 | 1226 | 900 | 978 | 0.024 |
| | 17D | 1100 | 1100 | 1197 | 1226 | 900 | 978 | 0.024 |
| | 17E | 1150 | 1100 | 1197 | 1226 | 900 | 978 | 0.024 |

| | | NITRIDING TREATMENT | | PRECIPITATES | | | MAGNETIC PROPERTY |
|---|---|---|---|---|---|---|---|
| | No. | RIGHT SIDE OF EXPRESSION (8) | RIGHT SIDE OF EXPRESSION (9) | $B_{asBN}$ (MASS %) | [B] − $B_{asBN}$ (MASS %) | $Se_{asMnSe}$ (MASS %) | MAGNETIC FLUX DENSITY B8 (T) |
| EXAMPLE | 17A | 0.017 | 0.022 | 0.0020 | 0.0002 | 0.0047 | 1.922 |
| | 17B | 0.017 | 0.022 | 0.0020 | 0.0002 | 0.0047 | 1.930 |
| | 17C | 0.017 | 0.022 | 0.0020 | 0.0002 | 0.0047 | 1.933 |
| | 17D | 0.017 | 0.022 | 0.0020 | 0.0002 | 0.0047 | 1.927 |
| | 17E | 0.017 | 0.022 | 0.0020 | 0.0002 | 0.0047 | 1.880 |

As listed in Table 18, in Example No. 17A, the heating rate in a temperature range of 1000° C. to 1100° C. was set to 15° C./h or less, so that the particularly good magnetic flux density was obtained. Further, in Examples No. 17B to 17D, the steel strips were kept in the temperature range of 1000° C. to 1100° C. for 10 hours, so that the particularly good magnetic flux density was obtained. On the other hand, in Example No. 17E, the temperature at which the steel strip was kept for 10 hours exceeded 1100° C., so that the magnetic flux density was slightly lower than those in Examples No. 17A to No. 17D.

Twenty-First Experiment

In the twenty-first experiment, the effect of the slab heating temperature in the case of no S being contained was confirmed.

In the twenty-first experiment, first, slabs containing Si: 3.3 mass %, C: 0.06 mass %, acid-soluble Al: 0.028 mass %, N: 0.008 mass %, Mn: 0.12 mass %, Se: 0.008 mass %, and B: 0.0019 mass %, and a balance being composed of Fe and inevitable impurities were manufactured. Next, the slabs were heated at a temperature listed in Table 19 (1100° C. to 1300° C.), and thereafter were subjected to finish rolling at 950° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.022 mass %. Next, an annealing separating agent containing MgO as its main component was coated on the steel strips, and the steel strips were heated up to 1200° C. at a rate of 15° C./h, and were finish annealed. Then, similarly to the fourth experiment, a magnetic property (the magnetic flux density B8) was measured. A result of the measurement is listed in Table 19.

TABLE 19

| | | SLAB HEATING | | | NITRIDING TREATMENT | PRECIPITATES | | | MAGNETIC PROPERTY MAGNETIC |
|---|---|---|---|---|---|---|---|---|---|
| | No. | HEATING TEMPERATURE (° C.) | T2 (° C.) | T3 (° C.) | N CONTENT (MASS %) | $B_{asBN}$ (MASS %) | [B] − $B_{asBN}$ (MASS %) | $Se_{asMnSe}$ (MASS %) | FLUX DENSITY B8 (T) |
| EXAMPLE | 18A | 1100 | 1239 | 1217 | 0.022 | 0.0018 | 0.0001 | 0.0070 | 1.929 |
| | 18B | 1150 | 1239 | 1217 | 0.022 | 0.0016 | 0.0003 | 0.0058 | 1.927 |
| | 18C | 1200 | 1239 | 1217 | 0.022 | 0.0011 | 0.0008 | 0.0040 | 1.917 |
| COMPARATIVE | 18D | 1250 | 1239 | 1217 | 0.022 | 0.0004 | 0.0015 | 0.0008 | 1.691 |
| EXAMPLE | 18E | 1300 | 1239 | 1217 | 0.022 | 0.0002 | 0.0017 | 0.0005 | 1.553 |

As listed in Table 19, in Examples No. 18A to No. 18C each having the slab heating temperature being the temperature T2 or lower and the temperature T3 or lower, the good magnetic flux density was obtained. On the other hand, in Comparative Examples No. 18D and No. 18E each having the slab heating temperature higher than the temperature T2 and the temperature T3, the magnetic flux density was low.

Twenty-Second Experiment

In the twenty-second experiment, the effect of the components of the slab in the case of no S being contained was confirmed.

In the twenty-second experiment, first, slabs containing components listed in Table 20 and a balance being composed of Fe and inevitable impurities were manufactured. Next, the slabs were heated at 1100° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and decarburization-annealed steel strips were obtained. Subsequently, the decarburization-annealed steel strips were annealed in an ammonia containing atmosphere to increase nitrogen in the steel strips up to 0.022 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 21.

TABLE 20

| | | COMPOSITION OF SILICON STEEL MATERIAL (MASS %) | | | | | | | | | | | | | | |
|---|---|---|---|---|---|---|---|---|---|---|---|---|---|---|---|---|
| | No. | Si | C | Al | N | Mn | Se | B | Cr | Cu | Ni | P | Mo | Sn | Sb | Bi |
| EXAMPLE | 19A | 3.3 | 0.06 | 0.027 | 0.008 | 0.15 | 0.006 | 0.002 | — | — | — | — | — | — | — | — |
| | 19B | 3.3 | 0.06 | 0.027 | 0.007 | 0.12 | 0.007 | 0.002 | 0.13 | — | — | — | — | — | — | — |
| | 19C | 3.4 | 0.06 | 0.025 | 0.008 | 0.12 | 0.007 | 0.002 | — | 0.22 | — | — | — | — | — | — |
| | 19D | 3.2 | 0.06 | 0.028 | 0.008 | 0.14 | 0.008 | 0.002 | — | — | 0.1 | — | — | — | — | — |
| | 19E | 3.4 | 0.06 | 0.027 | 0.007 | 0.11 | 0.006 | 0.002 | — | — | 0.4 | — | — | — | — | — |
| | 19F | 3.1 | 0.06 | 0.024 | 0.006 | 0.13 | 0.007 | 0.002 | — | — | 1.0 | — | — | — | — | — |
| | 19G | 3.3 | 0.06 | 0.029 | 0.007 | 0.10 | 0.008 | 0.002 | — | — | — | 0.04 | — | — | — | — |
| | 19H | 3.4 | 0.06 | 0.027 | 0.008 | 0.11 | 0.006 | 0.002 | — | — | — | — | 0.005 | — | — | — |
| | 19I | 3.1 | 0.06 | 0.028 | 0.008 | 0.13 | 0.007 | 0.002 | — | — | — | — | — | 0.06 | — | — |
| | 19J | 3.3 | 0.06 | 0.028 | 0.008 | 0.10 | 0.006 | 0.002 | — | — | — | — | — | — | 0.05 | — |
| | 19K | 3.3 | 0.06 | 0.030 | 0.009 | 0.10 | 0.008 | 0.002 | — | — | — | — | — | — | — | 0.002 |
| | 19L | 3.2 | 0.06 | 0.024 | 0.008 | 0.13 | 0.007 | 0.002 | 0.10 | — | — | 0.03 | — | 0.05 | — | — |
| | 19M | 3.7 | 0.06 | 0.027 | 0.008 | 0.10 | 0.007 | 0.002 | 0.08 | 0.17 | 0.1 | 0.02 | — | 0.07 | — | — |
| | 19N | 3.2 | 0.06 | 0.034 | 0.006 | 0.12 | 0.006 | 0.002 | 0.12 | — | — | — | 0.003 | 0.06 | — | 0.001 |
| | 19O | 2.8 | 0.06 | 0.021 | 0.007 | 0.10 | 0.006 | 0.002 | — | — | — | — | — | — | — | — |
| COMPARATIVE EXAMPLE | 19P | 3.1 | 0.06 | 0.030 | 0.009 | 0.10 | 0.002 | 0.002 | — | — | — | — | — | — | — | — |

TABLE 21

| | No. | PRECIPITATES $B_{asBN}$ (MASS %) | [B] − $B_{asBN}$ (MASS %) | $Se_{asMnSe}$ (MASS %) | MAGNETIC PROPERTY MAGNETIC FLUX DENSITY B8 (T) |
|---|---|---|---|---|---|
| EXAMPLE | 19A | 0.0018 | 0.0002 | 0.0054 | 1.923 |
| | 19B | 0.0019 | 0.0001 | 0.0060 | 1.924 |
| | 19C | 0.0019 | 0.0001 | 0.0061 | 1.929 |
| | 19D | 0.0018 | 0.0002 | 0.0071 | 1.925 |
| | 19E | 0.0019 | 0.0001 | 0.0048 | 1.920 |
| | 19F | 0.0019 | 0.0001 | 0.0061 | 1.883 |
| | 19G | 0.0018 | 0.0002 | 0.0068 | 1.929 |
| | 19H | 0.0019 | 0.0001 | 0.0049 | 1.925 |
| | 19I | 0.0018 | 0.0002 | 0.0062 | 1.926 |
| | 19J | 0.0019 | 0.0001 | 0.0046 | 1.924 |
| | 19K | 0.0019 | 0.0001 | 0.0067 | 1.928 |
| | 19L | 0.0018 | 0.0002 | 0.0060 | 1.929 |
| | 19M | 0.0019 | 0.0001 | 0.0058 | 1.928 |
| | 19N | 0.0018 | 0.0002 | 0.0049 | 1.926 |
| | 19O | 0.0018 | 0.0002 | 0.0046 | 1.938 |
| COMPARATIVE EXAMPLE | 19P | 0.0018 | 0.0002 | 0.0014 | 1.567 |

As listed in Table 21, in Examples No. 19A to No. 19O each using the slab having the appropriate composition, the good magnetic flux density was obtained, but in Comparative Example No. 19P having a Se content being less than the lower limit of the present invention range, the magnetic flux density was low.

Twenty-Third Experiment

In the twenty-third experiment, the effect of the nitriding treatment in the case of no S being contained was confirmed.

In the twenty-third experiment, first, slabs containing Si: 3.3 mass %, C: 0.06 mass %, acid-soluble Al: 0.027 mass %, N: 0.007 mass %, Mn: 0.12 mass %, Se: 0.007 mass %, and B: 0.0015 mass %, and a balance being composed of Fe and inevitable impurities were manufactured. Next, the slabs were heated at 1100° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained.

Thereafter, as for a sample of Comparative Example No. 20A, decarburization annealing was performed in a moist atmosphere gas at 830° C. for 100 seconds, and thereby a decarburization-annealed steel strip was obtained. Further, as for a sample of Example No. 20B, decarburization annealing was performed in a moist atmosphere gas at 830° C. for 100 seconds, and further annealing was performed in an ammonia containing atmosphere, and thereby a decarburization-annealed steel strip having an N content of 0.023 mass % was obtained. Further, as for a sample of Example No. 20C, decarburization annealing was performed in a moist atmosphere gas at 860° C. for 100 seconds, and thereby a decarburization-annealed steel strip having an N content of 0.023 mass % was obtained. In this manner, three types of the decarburization-annealed steel strips were obtained.

Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 22.

TABLE 22

| | No. | APPLICATION OR NO APPLICATION OF NITRIDING TREATMENT | SLAB HEATING HEATING TEMPERATURE (° C.) | T2 (° C.) | T3 (° C.) | NITRIDING TREATMENT N CONTENT (MASS %) | RIGHT SIDE OF EXPRESSION (3) | RIGHT SIDE OF EXPRESSION (4) | PRECIPITATES $B_{asBN}$ (MASS %) | [B] − $B_{asBN}$ (MASS %) | $Se_{asMnSe}$ (MASS %) | MAGNETIC PROPERTY MAGNETIC FLUX DENSITY B8 (T) |
|---|---|---|---|---|---|---|---|---|---|---|---|---|
| COMPARATIVE EXAMPLE | 20A | NOT APPLIED | 1100 | 1227 | 1195 | 0.007 | 0.016 | 0.020 | 0.0014 | 0.0001 | 0.0061 | 1.578 |
| EXAMPLE | 20B | APPLIED | 1100 | 1227 | 1195 | 0.023 | 0.016 | 0.020 | 0.0014 | 0.0001 | 0.0061 | 1.930 |
| | 20C | APPLIED | 1100 | 1227 | 1195 | 0.023 | 0.016 | 0.020 | 0.0014 | 0.0001 | 0.0061 | 1.927 |

As listed in Table 22, in Example No. 20B in which the nitriding treatment was performed after the decarburization annealing, and Example No. 20C in which the nitriding treatment was performed during the decarburization annealing, the good magnetic flux density was obtained. However, in Comparative Example No. 20A in which no nitriding treatment was performed, the magnetic flux density was low. Incidentally, the numerical value in the section of "NITRIDING TREATMENT" of Comparative Example No. 20A in Table 22 is a value obtained from the composition of the decarburization-annealed steel strip.

Twenty-Fourth Experiment

In the twenty-fourth experiment, the effect of the B content in the case of S and Se being contained was confirmed.

In the twenty-fourth experiment, first, slabs containing Si: 3.2 mass %, C: 0.05 mass %, acid-soluble Al: 0.028 mass %, N: 0.008 mass %, Mn: 0.1 mass %, S: 0.006 mass %, Se: 0.006 mass %, and B having an amount listed in Table 23 (0 mass % to 0.0045 mass %), and a balance being composed of Fe and inevitable impurities were manufactured. Next, the slabs were heated at 1100° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.023 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 23.

TABLE 23

| | | | SLAB HEATING | | | | NITRIDING TREATMENT | PRECIPITATES | | | MAGNETIC PROPERTY MAGNETIC FLUX |
|---|---|---|---|---|---|---|---|---|---|---|---|
| | No. | B CONTENT (MASS %) | HEATING TEMPERATURE (° C.) | T1 (° C.) | T2 (° C.) | T3 (° C.) | N CONTENT (MASS %) | $B_{asBN}$ (MASS %) | [B] − $B_{asBN}$ (MASS %) | $S_{asMnS}$ + 0.5 × $Se_{asMnSe}$ (MASS %) | DENSITY B8 (T) |
| COMPARATIVE EXAMPLE | 21A | 0 | 1100 | 1206 | 1197 | — | 0.023 | 0 | 0 | 0.007 | 1.882 |
| EXAMPLE | 21B | 0.0009 | 1100 | 1206 | 1197 | 1173 | 0.023 | 0.0009 | 0 | 0.007 | 1.919 |
| | 21C | 0.0018 | 1100 | 1206 | 1197 | 1214 | 0.023 | 0.0017 | 0.0001 | 0.007 | 1.931 |
| | 21D | 0.0028 | 1100 | 1206 | 1197 | 1241 | 0.023 | 0.0027 | 0.0001 | 0.007 | 1.929 |
| | 21E | 0.0045 | 1100 | 1206 | 1197 | 1271 | 0.023 | 0.0044 | 0.0001 | 0.007 | 1.925 |

As listed in Table 23, in Comparative Example No. 21A having no B contained in the slab, the magnetic flux density was low, but in Examples No. 21B to No. 21E each having an appropriate amount of B contained in the slab, the good magnetic flux density was obtained.

Twenty-Fifth Experiment

In the twenty-fifth experiment, the effects of the B content and the slab heating temperature in the case of S and Se being contained were confirmed.

In the twenty-fifth experiment, first, slabs containing Si: 3.2 mass %, C: 0.05 mass %, acid-soluble Al: 0.028 mass %, N: 0.008 mass %, Mn: 0.1 mass %, S: 0.006 mass %, Se: 0.006 mass %, and B having an amount listed in Table 24 (0 mass % to 0.0045 mass %), and a balance being composed of Fe and inevitable impurities were manufactured. Next, the slabs were heated at 1180° C., and thereafter were subjected to finish rolling at 950° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.023 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 24.

TABLE 24

| | | | SLAB HEATING | | | | NITRIDING TREATMENT | PRECIPITATES | | | MAGNETIC PROPERTY MAGNETIC FLUX |
|---|---|---|---|---|---|---|---|---|---|---|---|
| | No. | B CONTENT (MASS %) | HEATING TEMPERATURE (° C.) | T1 (° C.) | T2 (° C.) | T3 (° C.) | N CONTENT (MASS %) | $B_{asBN}$ (MASS %) | [B] − $B_{asBN}$ (MASS %) | $S_{asMnS}$ + 0.5 × $Se_{asMnSe}$ (MASS %) | DENSITY B8 (T) |
| COMPARATIVE EXAMPLE | 22A | 0 | 1180 | 1206 | 1197 | — | 0.023 | 0 | 0 | 0.003 | 1.879 |
| EXAMPLE | 22B | 0.0009 | 1180 | 1206 | 1197 | 1173 | 0.023 | 0.0003 | 0.0006 | 0.003 | 1.634 |
| | 22C | 0.0018 | 1180 | 1206 | 1197 | 1214 | 0.023 | 0.0013 | 0.0005 | 0.003 | 1.922 |
| | 22D | 0.0028 | 1180 | 1206 | 1197 | 1241 | 0.023 | 0.0023 | 0.0005 | 0.003 | 1.927 |
| | 22E | 0.0045 | 1180 | 1206 | 1197 | 1271 | 0.023 | 0.0038 | 0.0007 | 0.003 | 1.920 |

As listed in Table 24, in Comparative Example No. 22A having no B contained in the slab and Comparative Example No. 22B having the slab heating temperature higher than the temperature T3, the magnetic flux density was low. On the other hand, in Examples No. 22C to No. 22E each having an appropriate amount of B contained in the slab and having the slab heating temperature being the temperature T1 or lower, the temperature T2 or lower, and the temperature T3 or lower, the good magnetic flux density was obtained.

Twenty-Sixth Experiment

In the twenty-sixth experiment, the effects of the Mn content and the slab heating temperature in the case of S and Se being contained were confirmed.

In the twenty-sixth experiment, first, slabs containing Si: 3.3 mass %, C: 0.06 mass %, acid-soluble Al: 0.028 mass %, N: 0.009 mass %, S: 0.006 mass %, Se: 0.004 mass %, B: 0.002 mass %, and Mn having an amount listed in Table 25 (0.05 mass % to 0.20 mass %), and a balance being composed of Fe and inevitable impurities were manufactured. Next, the slabs were heated at 1200° C., and thereafter were subjected to finish rolling at 950° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.022 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 25.

As listed in Table 25, in Comparative Examples No. 23A and No. 23B each having the slab heating temperature higher than the temperature T1 and the temperature T2, the magnetic flux density was low. On the other hand, in Examples No. 23C and No. 23D each having the slab heating temperature being the temperature T1 or lower, the temperature T2 or lower, and the temperature T3 or lower, the good magnetic flux density was obtained.

Twenty-Seventh Experiment

In the twenty-seventh experiment, the effect of the finish temperature Tf of the finish rolling in the hot rolling in the case of S and Se being contained was confirmed.

In the twenty-seventh experiment, first, slabs containing Si: 3.3 mass %, C: 0.06 mass %, acid-soluble Al: 0.027 mass %, N: 0.008 mass %, Mn: 0.12 mass %, S: 0.005 mass %, Se: 0.005 mass %, and B: 0.002 mass %, and a balance being composed of Fe and inevitable impurities were manufactured. Next, the slabs were heated at 1180° C., and thereafter were subjected to finish rolling at the finish temperature Tf listed in Table 26 (800° C. to 1000° C.). In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.022 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 26.

TABLE 25

| | | | SLAB HEATING | | | | NITRIDING TREATMENT | PRECIPITATES | | | MAGNETIC PROPERTY MAGNETIC FLUX |
|---|---|---|---|---|---|---|---|---|---|---|---|
| | No. | Mn CONTENT (MASS %) | HEATING TEMPERATURE (° C.) | T1 (° C.) | T2 (° C.) | T3 (° C.) | N CONTENT (MASS %) | $B_{asBN}$ (MASS %) | [B] − $B_{asBN}$ (MASS %) | $S_{asMnS}$ + 0.5 × $Se_{asMnSe}$ (MASS %) | DENSITY B8 (T) |
| COMPARATIVE | 23A | 0.05 | 1200 | 1163 | 1107 | 1227 | 0.022 | 0.0011 | 0.0009 | 0.001 | 1.824 |
| EXAMPLE | 23B | 0.08 | 1200 | 1192 | 1144 | 1227 | 0.022 | 0.0012 | 0.0008 | 0.001 | 1.835 |
| EXAMPLE | 23C | 0.16 | 1200 | 1237 | 1203 | 1227 | 0.022 | 0.0016 | 0.0004 | 0.004 | 1.931 |
| | 23D | 0.20 | 1200 | 1252 | 1222 | 1227 | 0.022 | 0.0017 | 0.0003 | 0.005 | 1.925 |

TABLE 26

| | No. | SLAB HEATING: HEATING TEMPERATURE (° C.) | T1 (° C.) | T2 (° C.) | T3 (° C.) | FINISH ROLLING: FINISH TEMPERATURE Tf (° C.) | RIGHT SIDE OF EXPRESSION (4) | NITRIDING TREATMENT: N CONTENT (MASS %) | PRECIPITATES: $B_{asBN}$ (MASS %) | [B]−$B_{asBN}$ (MASS %) | $S_{asMnS}$ + 0.5 × $Se_{asMnSe}$ (MASS %) | MAGNETIC PROPERTY MAGNETIC FLUX DENSITY B8 (T) |
|---|---|---|---|---|---|---|---|---|---|---|---|---|
| EXAMPLE | 24A | 1180 | 1206 | 1197 | 1220 | 800 | 980 | 0.022 | 0.0016 | 0.0004 | 0.003 | 1.929 |
| | 24B | 1180 | 1206 | 1197 | 1220 | 850 | 980 | 0.022 | 0.0016 | 0.0004 | 0.003 | 1.930 |
| | 24C | 1180 | 1206 | 1197 | 1220 | 900 | 980 | 0.022 | 0.0015 | 0.0005 | 0.003 | 1.928 |
| COMPARATIVE EXAMPLE | 24D | 1180 | 1206 | 1197 | 1220 | 1000 | 980 | 0.022 | 0.0012 | 0.0008 | 0.003 | 1.895 |

In the case of the B content being 0.002 mass % (20 ppm), the finish temperature Tf is necessary to be 980° C. or lower based on inequation (4). Then, as listed in Table 26, in Examples No. 24A to 24C each satisfying the condition, the good magnetic flux density was obtained, but in Comparative Example No. 24D not satisfying the condition, the magnetic flux density was low.

Twenty-Eighth Experiment

In the twenty-eighth experiment, the effect of the N content after the nitriding treatment in the case of S and Se being contained was confirmed.

In the twenty-eighth experiment, first, slabs containing Si: 3.3 mass %, C: 0.06 mass %, acid-soluble Al: 0.028 mass %, N: 0.008 mass %, Mn: 0.14 mass %, S: 0.005 mass %, Se: 0.005 mass %, and B: 0.002 mass %, a content of Ti that is an impurity being 0.0018 mass %, and a balance being composed of Fe and inevitable impurities were manufactured. Next, the slabs were heated at 1150° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to an amount listed in Table 27 (0.012 mass % to 0.028 mass %). Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 27.

TABLE 27

| | No. | SLAB HEATING: HEATING TEMPERATURE (° C.) | T1 (° C.) | T2 (° C.) | T3 (° C.) | FINISH ROLLING: FINISH TEMPERATURE Tf (° C.) | RIGHT SIDE OF EXPRESSION (4) | NITRIDING TREATMENT: N CONTENT (MASS %) | RIGHT SIDE OF EXPRESSION (8) |
|---|---|---|---|---|---|---|---|---|---|
| EXAMPLE | 25A | 1150 | 1216 | 1211 | 1220 | 900 | 980 | 0.012 | 0.018 |
| | 25B | 1150 | 1216 | 1211 | 1220 | 900 | 980 | 0.017 | 0.018 |
| | 25C | 1150 | 1216 | 1211 | 1220 | 900 | 980 | 0.022 | 0.018 |
| | 25D | 1150 | 1216 | 1211 | 1220 | 900 | 980 | 0.028 | 0.018 |

| | No. | NITRIDING TREATMENT RIGHT SIDE OF EXPRESSION (9) | PRECIPITATES: $B_{asBN}$ (MASS %) | [B] − $B_{asBN}$ (MASS %) | $S_{asMnS}$ + 0.5 × $Se_{asMnSe}$ (MASS %) | MAGNETIC PROPERTY MAGNETIC FLUX DENSITY B8 (T) |
|---|---|---|---|---|---|---|
| EXAMPLE | 25A | 0.022 | 0.0018 | 0.0002 | 0.004 | 1.883 |
| | 25B | 0.022 | 0.0018 | 0.0002 | 0.004 | 1.911 |
| | 25C | 0.022 | 0.0018 | 0.0002 | 0.004 | 1.926 |
| | 25D | 0.022 | 0.0018 | 0.0002 | 0.004 | 1.928 |

As listed in Table 27, in Examples No. 25C and No. 25D in which an N content after the nitriding treatment satisfied the relation of inequation (8) and the relation of inequation (9), the particularly good magnetic flux density was obtained. On the other hand, in Examples No. 25A and No. 25B in which an N content after the nitriding treatment did not satisfy the relation of inequation (8) and the relation of inequation (9), the magnetic flux density was slightly lower than those in Examples No. 25C and No. 25D.

Twenty-Ninth Experiment

In the twenty-ninth experiment, the effect of the condition of the finish annealing in the case of S and Se being contained was confirmed.

In the twenty-ninth experiment, first, slabs containing Si: 3.3 mass %, C: 0.06 mass %, acid-soluble Al: 0.028 mass %, N: 0.008 mass %, Mn: 0.14 mass %, S: 0.005 mass %, Se: 0.005 mass %, and B: 0.002 mass %, a content of Ti that is an impurity being 0.0018 mass %, and a balance being composed of Fe and inevitable impurities were manufactured. Next, the slabs were heated at 1150° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.023 mass %. Next, an annealing separating agent containing MgO as its main component was coated on the steel strips, and the steel strips were heated up to 1000° C. at a rate of 15° C./h, and further were heated up to 1200° C. at a rate listed in Table 28 (5° C./h to 30° C./h) and were finish annealed. Then, similarly to the fourth experiment, a magnetic property (the magnetic flux density B8) was measured. A result of the measurement is listed in Table 28.

As listed in Table 28, in Examples No. 26A to No. 26C, the heating rate in a temperature range of 1000° C. to 1100° C. was set to 15° C./h or less, so that the particularly good magnetic flux density was obtained. On the other hand, in Example No. 26D, the heating rate in the temperature range exceeded 15° C./h, so that the magnetic flux density was slightly lower than those in Examples No. 26A to No. 26C.

Thirtieth Experiment

In the thirtieth experiment, the effect of the condition of the finish annealing in the case of S and Se being contained was confirmed.

In the thirtieth experiment, first, slabs containing Si: 3.3 mass %, C: 0.06 mass %, acid-soluble Al: 0.028 mass %, N: 0.008 mass %, Mn: 0.14 mass %, S: 0.005 mass %, Se: 0.005 mass %, and B: 0.002 mass %, a content of Ti that is an impurity being 0.0018 mass %, and a balance being composed of Fe and inevitable impurities were manufactured. Next, the slabs were heated at 1150° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.024 mass %. Next, an annealing separating agent containing MgO as its main component was coated on the steel strips. Then, in Example No. 27A, the steel strip was heated up to 1200° C. at a rate of 15° C./h and was finish annealed. Further, in Examples No. 27B to No. 27E, the steel strips were heated up to a temperature listed in Table 29 (1000° C. to 1150° C.) at a rate of 30° C./h and were kept for 10 hours at the temperature, and thereafter were heated up to 1200° C. at a rate of 30° C./h and were finish annealed. Then, similarly to the fourth experi-

TABLE 28

| | | FINISH ANNEALING | SLAB HEATING | | | | FINISH ROLLING | | NITRIDING TREATMENT |
|---|---|---|---|---|---|---|---|---|---|
| | No. | HEATING SPEED (° C./h) | HEATING TEMPERATURE (° C.) | T1 (° C.) | T2 (° C.) | T3 (° C.) | FINISH TEMPERATURE Tf (° C.) | RIGHT SIDE OF EXPRESSION (4) | N CONTENT (MASS %) |
| EXAMPLE | 26A | 5 | 1150 | 1216 | 1211 | 1220 | 900 | 980 | 0.023 |
| | 26B | 10 | 1150 | 1216 | 1211 | 1220 | 900 | 980 | 0.023 |
| | 26C | 15 | 1150 | 1216 | 1211 | 1220 | 900 | 980 | 0.023 |
| | 26D | 30 | 1150 | 1216 | 1211 | 1220 | 900 | 980 | 0.023 |

| | | NITRIDING TREATMENT | | PRECIPITATES | | | MAGNETIC PROPERTY |
|---|---|---|---|---|---|---|---|
| | No. | RIGHT SIDE OF EXPRESSION (8) | RIGHT SIDE OF EXPRESSION (9) | $B_{asBN}$ (MASS %) | $[B] - B_{asBN}$ (MASS %) | $S_{asMnS} + 0.5 \times Se_{asMnSe}$ (MASS %) | MAGNETIC FLUX DENSITY B8 (T) |
| EXAMPLE | 26A | 0.018 | 0.022 | 0.0018 | 0.0002 | 0.004 | 1.932 |
| | 26B | 0.018 | 0.022 | 0.0018 | 0.0002 | 0.004 | 1.928 |
| | 26C | 0.018 | 0.022 | 0.0018 | 0.0002 | 0.004 | 1.922 |
| | 26D | 0.018 | 0.022 | 0.0018 | 0.0002 | 0.004 | 1.899 |

ment, a magnetic property (the magnetic flux density B8) was measured. A result of the measurement is listed in Table 29.

TABLE 29

| | | FINISH ANNEALING | SLAB HEATING | | | | FINISH ROLLING | | NITRIDING |
|---|---|---|---|---|---|---|---|---|---|
| | No. | MAINTAINING TEMPERATURE (° C.) | HEATING TEMPERATURE (° C.) | T1 (° C.) | T2 (° C.) | T3 (° C.) | FINISH TEMPERATURE Tf (° C.) | RIGHT SIDE OF EXPRESSION (4) | TREATMENT N CONTENT (MASS %) |
| EXAMPLE | 27A | — | 1150 | 1216 | 1211 | 1220 | 900 | 980 | 0.024 |
| | 27B | 1000 | 1150 | 1216 | 1211 | 1220 | 900 | 980 | 0.024 |
| | 27C | 1050 | 1150 | 1216 | 1211 | 1220 | 900 | 980 | 0.024 |
| | 27D | 1100 | 1150 | 1216 | 1211 | 1220 | 900 | 980 | 0.024 |
| | 27E | 1150 | 1150 | 1216 | 1211 | 1220 | 900 | 980 | 0.024 |

| | | NITRIDING TREATMENT | | PRECIPITATES | | | MAGNETIC PROPERTY |
|---|---|---|---|---|---|---|---|
| | No. | RIGHT SIDE OF EXPRESSION (8) | RIGHT SIDE OF EXPRESSION (9) | $B_{asBN}$ (MASS %) | $[B] - B_{asBN}$ (MASS %) | $S_{asMnS} + 0.5 \times Se_{asMnSe}$ (MASS %) | MAGNETIC FLUX DENSITY B8 (T) |
| EXAMPLE | 27A | 0.018 | 0.022 | 0.0018 | 0.0002 | 0.004 | 1.907 |
| | 27B | 0.018 | 0.022 | 0.0018 | 0.0002 | 0.004 | 1.926 |
| | 27C | 0.018 | 0.022 | 0.0018 | 0.0002 | 0.004 | 1.934 |
| | 27D | 0.018 | 0.022 | 0.0018 | 0.0002 | 0.004 | 1.928 |
| | 27E | 0.018 | 0.022 | 0.0018 | 0.0002 | 0.004 | 1.891 |

As listed in Table 29, in Example No. 27A, the heating rate in a temperature range of 1000° C. to 1100° C. was set to 15° C./h or less, so that the particularly good magnetic flux density was obtained. Further, in Examples No. 27B to 27D, the steel strips were kept in the temperature range of 1000° C. to 1100° C. for 10 hours, so that the particularly good magnetic flux density was obtained. On the other hand, in Example No. 27E, the temperature at which the steel strip was kept for 10 hours exceeded 1100° C., so that the magnetic flux density was slightly lower than those in Examples No. 27A to No. 27D.

Thirty-First Experiment

In the thirty-first experiment, the effect of the slab heating temperature in the case of S and Se being contained was confirmed.

In the thirty-first experiment, first, slabs containing Si: 3.1 mass %, C: 0.05 mass %, acid-soluble Al: 0.027 mass %, N: 0.008 mass %, Mn: 0.11 mass %, S: 0.006 mass %, Se: 0.007 mass %, and B: 0.0025 mass %, and a balance being composed of Fe and inevitable impurities were manufactured. Next, the slabs were heated at a temperature listed in Table 30 (1100° C. to 1300° C.), and thereafter were subjected to finish rolling at 950° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.021 mass %. Next, an annealing separating agent containing MgO as its main component was coated on the steel strips, and the steel strips were heated up to 1200° C. at a rate of 15° C./h, and were finish annealed. Then, similarly to the fourth experiment, a magnetic property (the magnetic flux density B8) was measured. A result of the measurement is listed in Table 30.

TABLE 30

| | | SLAB HEATING | | | | NITRIDING | PRECIPITATES | | | MAGNETIC PROPERTY MAGNETIC |
|---|---|---|---|---|---|---|---|---|---|---|
| | No. | HEATING TEMPERATURE (° C.) | T1 (° C.) | T2 (° C.) | T3 (° C.) | TREATMENT N CONTENT (MASS %) | $B_{asBN}$ (MASS %) | $[B] - B_{asBN}$ (MASS %) | $S_{asMnS} + 0.5 \times Se_{asMnSe}$ (MASS %) | FLUX DENSITY B8 (T) |
| EXAMPLE | 28A | 1100 | 1212 | 1219 | 1234 | 0.021 | 0.0023 | 0.0002 | 0.008 | 1.931 |
| | 28B | 1150 | 1212 | 1219 | 1234 | 0.021 | 0.0021 | 0.0004 | 0.006 | 1.928 |
| | 28C | 1200 | 1212 | 1219 | 1234 | 0.021 | 0.0018 | 0.0007 | 0.002 | 1.921 |
| COMPARATIVE | 28D | 1250 | 1212 | 1219 | 1234 | 0.021 | 0.0004 | 0.0021 | 0.001 | 1.772 |
| EXAMPLE | 28E | 1300 | 1212 | 1219 | 1234 | 0.021 | 0.0002 | 0.0023 | 0.001 | 1.654 |

As listed in Table 30, in Examples No. 28A to No. 28C each having the slab heating temperature being the temperature T1 or lower, the temperature T2 or lower, and the temperature T3 or lower, the good magnetic flux density was obtained. On the other hand, in Comparative Examples No. 28D and No. 28E each having the slab heating temperature higher than the temperature T1, the temperature T2, and the temperature T3, the magnetic flux density was low.

Thirty-Second Experiment

In the thirty-second experiment, the effect of the components of the slab in the case of S and Se being contained was confirmed.

In the thirty-second experiment, first, slabs containing components listed in Table 31 and a balance being composed of Fe and inevitable impurities were manufactured. Next, the slabs were heated at 1100° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained. Thereafter, decarburization annealing was performed in a moist atmosphere gas at 830° C. for 100 seconds, and thereby decarburization-annealed steel strips were obtained. Subsequently, the decarburization-annealed steel strips were annealed in an ammonia containing atmosphere to increase nitrogen in the steel strips up to 0.023 mass %. Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 32.

TABLE 31

| | | COMPOSITION OF SILICON STEEL MATERIAL (MASS %) | | | | | | | | | | | | | | | |
|---|---|---|---|---|---|---|---|---|---|---|---|---|---|---|---|---|---|
| | No. | Si | C | Al | N | Mn | S | Se | B | Cr | Cu | Ni | P | Mo | Sn | Sb | Bi |
| EXAMPLE | 29A | 3.3 | 0.06 | 0.028 | 0.008 | 0.12 | 0.005 | 0.007 | 0.002 | — | — | — | — | — | — | — | — |
| | 29B | 3.2 | 0.06 | 0.027 | 0.009 | 0.12 | 0.007 | 0.005 | 0.002 | 0.15 | — | — | — | — | — | — | — |
| | 29C | 3.4 | 0.06 | 0.025 | 0.008 | 0.12 | 0.006 | 0.007 | 0.002 | — | 0.2 | — | — | — | — | — | — |
| | 29D | 3.3 | 0.06 | 0.027 | 0.008 | 0.12 | 0.006 | 0.007 | 0.002 | — | — | 0.1 | — | — | — | — | — |
| | 29E | 3.3 | 0.06 | 0.024 | 0.007 | 0.12 | 0.006 | 0.007 | 0.002 | — | — | 0.4 | — | — | — | — | — |
| COMPARATIVE EXAMPLE | 29F | 3.1 | 0.06 | 0.027 | 0.009 | 0.12 | 0.006 | 0.007 | 0.002 | — | — | 1.3 | — | — | — | — | — |
| EXAMPLE | 29G | 3.4 | 0.06 | 0.028 | 0.007 | 0.12 | 0.006 | 0.007 | 0.002 | — | — | — | 0.03 | — | — | — | — |
| | 29H | 3.2 | 0.06 | 0.027 | 0.008 | 0.12 | 0.006 | 0.007 | 0.002 | — | — | — | — | 0.005 | — | — | — |
| | 29I | 3.3 | 0.06 | 0.028 | 0.008 | 0.12 | 0.006 | 0.007 | 0.002 | — | — | — | — | — | 0.04 | — | — |
| | 29J | 3.3 | 0.06 | 0.025 | 0.008 | 0.12 | 0.006 | 0.007 | 0.002 | — | — | — | — | — | — | 0.04 | — |
| | 29K | 3.3 | 0.06 | 0.024 | 0.009 | 0.12 | 0.006 | 0.007 | 0.002 | — | — | — | — | — | — | — | 0.003 |
| | 29L | 3.2 | 0.06 | 0.030 | 0.008 | 0.12 | 0.006 | 0.004 | 0.002 | 0.10 | — | — | 0.03 | — | 0.06 | — | — |
| | 29M | 3.8 | 0.06 | 0.027 | 0.008 | 0.12 | 0.005 | 0.005 | 0.002 | 0.05 | 0.15 | 0.05 | 0.02 | — | 0.04 | — | — |
| | 29N | 3.3 | 0.06 | 0.028 | 0.009 | 0.12 | 0.006 | 0.004 | 0.002 | 0.08 | — | — | — | 0.003 | 0.05 | — | 0.001 |
| | 29O | 2.8 | 0.06 | 0.022 | 0.008 | 0.12 | 0.004 | 0.007 | 0.002 | — | — | — | — | — | — | — | — |
| COMPARATIVE EXAMPLE | 29P | 3.3 | 0.06 | 0.035 | 0.007 | 0.12 | 0.001 | 0.0003 | 0.002 | — | — | — | — | — | — | — | — |

TABLE 32

| | | PRECIPITATES | | | MAGNETIC PROPERTY |
|---|---|---|---|---|---|
| | No. | $B_{asBN}$ (MASS %) | $[B] - B_{asBN}$ (MASS %) | $S_{asMnS} + 0.5 \times Se_{asMnSe}$ (MASS %) | MAGNETIC FLUX DENSITY B8 (T) |
| EXAMPLE | 29A | 0.0018 | 0.0002 | 0.007 | 1.924 |
| | 29B | 0.0019 | 0.0001 | 0.008 | 1.925 |
| | 29C | 0.0018 | 0.0002 | 0.008 | 1.931 |
| | 29D | 0.0018 | 0.0002 | 0.008 | 1.925 |
| | 29E | 0.0018 | 0.0002 | 0.008 | 1.924 |
| COMPARATIVE EXAMPLE | 29F | 0.0019 | 0.0001 | 0.008 | 1.713 |
| EXAMPLE | 29G | 0.0018 | 0.0002 | 0.008 | 1.931 |
| | 29H | 0.0019 | 0.0001 | 0.008 | 1.924 |
| | 29I | 0.0018 | 0.0002 | 0.008 | 1.924 |
| | 29J | 0.0019 | 0.0001 | 0.008 | 1.927 |
| | 29K | 0.0019 | 0.0001 | 0.008 | 1.926 |
| | 29L | 0.0018 | 0.0002 | 0.007 | 1.932 |
| | 29M | 0.0019 | 0.0001 | 0.006 | 1.930 |
| | 29N | 0.0019 | 0.0001 | 0.007 | 1.927 |
| | 29O | 0.0018 | 0.0002 | 0.006 | 1.939 |
| COMPARATIVE EXAMPLE | 29P | 0.0018 | 0.0002 | 0.001 | 1.578 |

As listed in Table 32, in Examples No. 29A to No. 29E and No. 29G to No. 29O each using the slab having the appropriate composition, the good magnetic flux density was obtained, but in Comparative Example No. 29F having a Ni content higher than the upper limit of the present invention range and Comparative Example No. 29P having a total amount of a content of S and Se being less than the lower limit of the present invention range, the magnetic flux density was low.

Thirty-Third Experiment

In the thirty-third experiment, the effect of the nitriding treatment in the case of S and Se being contained was confirmed.

In the thirty-third experiment, first, slabs containing Si: 3.2 mass %, C: 0.06 mass %, acid-soluble Al: 0.027 mass %, N: 0.007 mass %, Mn: 0.14 mass %, S: 0.006 mass %, Se: 0.005 mass %, and B: 0.0015 mass %, and a balance being composed of Fe and inevitable impurities were manufactured. Next, the slabs were heated at 1150° C., and thereafter were subjected to finish rolling at 900° C. In this manner, hot-rolled steel strips each having a thickness of 2.3 mm were obtained. Subsequently, annealing of the hot-rolled steel strips was performed at 1100° C. Next, cold rolling was performed, and thereby cold-rolled steel strips each having a thickness of 0.22 mm were obtained.

Thereafter, as for a sample of Comparative Example No. 30A, decarburization annealing was performed in a moist atmosphere gas at 830° C. for 100 seconds, and thereby a decarburization-annealed steel strip was obtained. Further, as for a sample of Example No. 30B, decarburization annealing was performed in a moist atmosphere gas at 830° C. for 100 seconds, and further annealing was performed in an ammonia containing atmosphere, and thereby a decarburization-annealed steel strip having an N content of 0.021 mass % was obtained. Further, as for a sample of Example No. 30C, decarburization annealing was performed in a moist atmosphere gas at 860° C. for 100 seconds, and thereby a decarburization-annealed steel strip having an N content of 0.021 mass % was obtained. In this manner, three types of the decarburization-annealed steel strips were obtained.

Next, an annealing separating agent containing MgO as its main component was coated on the steel strips, and the steel strips were heated up to 1200° C. at a rate of 15° C./h and were finish annealed. Then, similarly to the fourth experiment, a magnetic property (the magnetic flux density B8) was measured. A result of the measurement is listed in Table 33.

TABLE 33

| | | APPLICATION OR | SLAB HEATING | | | | NITRIDING TREATMENT | |
|---|---|---|---|---|---|---|---|---|
| | No. | NO APPLICATION OF NITRIDING TREATMENT | HEATING TEMPERATURE (° C.) | T1 (° C.) | T2 (° C.) | T3 (° C.) | N CONTENT (MASS %) | RIGHT SIDE OF EXPRESSION (3) |
| COMPARATIVE EXAMPLE | 30A | NOT APPLIED | 1150 | 1228 | 1211 | 1195 | 0.007 | 0.016 |
| EXAMPLE | 30B | APPLIED | 1150 | 1228 | 1211 | 1195 | 0.021 | 0.016 |
| | 30C | APPLIED | 1150 | 1228 | 1211 | 1195 | 0.021 | 0.016 |

| | | NITRIDING TREATMENT | PRECIPITATES | | | MAGNETIC PROPERTY MAGNETIC |
|---|---|---|---|---|---|---|
| | No. | RIGHT SIDE OF EXPRESSION (4) | $B_{asBN}$ (MASS %) | $[B] - B_{asBN}$ (MASS %) | $S_{asMnS} + 0.5 \times Se_{asMnSe}$ (MASS %) | FLUX DENSITY B8 (T) |
| COMPARATIVE EXAMPLE | 30A | 0.020 | 0.0014 | 0.0001 | 0.006 | 1.645 |
| EXAMPLE | 30B | 0.020 | 0.0014 | 0.0001 | 0.006 | 1.932 |
| | 30C | 0.020 | 0.0014 | 0.0001 | 0.006 | 1.929 |

As listed in Table 33, in Example No. 30B in which the nitriding treatment was performed after the decarburization annealing, and Example No. 30C in which the nitriding treatment was performed during the decarburization annealing, the good magnetic flux density was obtained. However, in Comparative Example No. 30A in which no nitriding treatment was performed, the magnetic flux density was low. Incidentally, the numerical value in the section of "NITRIDING TREATMENT" of Comparative Example No. 30A in Table 33 is a value obtained from the composition of the decarburization-annealed steel strip.

INDUSTRIAL APPLICABILITY

The present invention can be utilized in, for example, an industry of manufacturing electrical steel sheets and an industry in which electrical steel sheets are used.

The invention claimed is:

1. A manufacturing method of a grain-oriented electrical steel sheet, comprising:

at a predetermined temperature, heating a silicon steel material containing Si: 0.8 mass % to 7 mass %, acid-soluble Al: 0.01 mass % to 0.065 mass %, N: 0.004 mass % to 0.012 mass %, Mn: 0.05 mass % to 1 mass %, and B: 0.0005 mass % to 0.0080 mass %, the silicon steel material further containing at least one element selected from a group consisting of S and Se being 0.003 mass % to 0.015 mass % in total amount, a C content being 0.085 mass % or less, and a balance being composed of Fe and inevitable impurities;

hot rolling the heated silicon steel material so as to obtain a hot-rolled steel strip;

annealing the hot-rolled steel strip so as to obtain an annealed steel strip;

cold rolling the annealed steel strip one time or more so as to obtain a cold-rolled steel strip;

decarburization annealing the cold-rolled steel strip so as to obtain a decarburization-annealed steel strip in which primary recrystallization is caused;

coating an annealing separating agent containing MgO as its main component on the decarburization-annealed steel strip; and causing secondary recrystallization by finish annealing the coated decarburization-annealed steel strip, wherein the method further comprises performing a nitriding treatment in which an N content of the decarburization-annealed steel strip is increased between start of the decarburization annealing and occurrence of the secondary recrystallization in the finish annealing, wherein:

in a case when S and Se are both contained in the silicon steel material, the predetermined temperature is lower than each of T1 (° C.), T2 (° C.) and T3 (° C.), the temperature T1 being expressed by equation (1) below, the temperature T2 being expressed by equation (2) below, and the temperature T3 being expressed by equation (3) below;

in a case when S is contained but no Se is contained in the silicon steel material, the predetermined temperature is lower than each of T1 (° C.) and T3 (° C.);

in a case when Se is contained but no S is contained in the silicon steel material, the predetermined temperature is lower than each of T2 (° C.) and T3 (° C.);

a finish temperature Tf of finish rolling in the hot rolling satisfies inequation (4) below, and amounts of BN, MnS, and MnSe in the hot-rolled steel strip satisfy inequations (5), (6), and (7) below, $$T1=14855/(6.82-\log([Mn]\times[S]))-273 \quad (1)$$

$$T2=10733/(4.08-\log([Mn]\times[Se]))-273 \quad (2)$$

$$T3=16000/(5.92-\log([B]\times[N]))-273 \quad (3)$$

$$Tf\leqq 1000-10000\times[B] \quad (4)$$

$$B_{asBN}\geqq 0.0005 \quad (5)$$

$$[B]-B_{asBN}\leqq 0.001 \quad (6)$$

$$S_{asMnS}+0.5\times Se_{asMnSe}\geqq 0.002 \quad (7)$$

wherein, [Mn] represents a Mn content (mass %) of the silicon steel material, [S] represents an S content (mass %) of the silicon steel material, [Se] represents a Se content (mass %) of the silicon steel material, [B] represents a B content (mass %) of the silicon steel material, [N] represents an N content (mass %) of the silicon steel material, $B_{asBN}$ represents an amount of B (mass %) that has precipitated as BN in the hot-rolled steel strip, $S_{asMnS}$ represents an amount of S (mass %) that has precipitated as MnS in the hot-rolled steel strip, and $Se_{asMnSe}$ represents an amount of Se (mass %) that has precipitated as MnSe in the hot-rolled steel strip.

2. The manufacturing method of the grain-oriented electrical steel sheet according to claim 1, wherein the nitriding treatment is performed under a condition that an N content [N] of a steel strip obtained after the nitriding treatment satisfies inequation (8) below, $$[N]\geqq 14/27[Al]+14/11[B]+14/47[Ti] \quad (8)$$

wherein, [N] represents the N content (mass %) of the steel strip obtained after the nitriding treatment, [Al] represents an acid-soluble Al content (mass %) of the steel strip obtained after the nitriding treatment, and [Ti] represents a Ti content (mass %) of the steel strip obtained after the nitriding treatment.

3. The manufacturing method of the grain-oriented electrical steel sheet according to claim 1, wherein the nitriding treatment is performed under a condition that an N content [N] of a steel strip obtained after the nitriding treatment satisfies inequation (9) below, $$[N]\geqq 2/3[Al]+14/11[B]+14/47[Ti] \quad (9)$$

wherein, [N] represents the N content (mass %) of the steel strip obtained after the nitriding treatment, [Al] represents an acid-soluble Al content (mass %) of the steel strip obtained after the nitriding treatment, and [Ti] represents a Ti content (mass %) of the steel strip obtained after the nitriding treatment.

4. The manufacturing method of the grain-oriented electrical steel sheet according to claim 1, wherein the step of causing the secondary recrystallization includes heating the coated decarburization-annealed steel strip at a rate of 15° C./h or less in a temperature range of 1000° C. to 1100° C. in the finish annealing.

5. The manufacturing method of the grain-oriented electrical steel sheet according to claim 2, wherein the step of causing the secondary recrystallization includes heating the coated decarburization-annealed steel strip at a rate of 15° C./h or less in a temperature range of 1000° C. to 1100° C. in the finish annealing.

6. The manufacturing method of the grain-oriented electrical steel sheet according to claim 3, wherein the step of causing the secondary recrystallization includes heating the coated decarburization-annealed steel strip at a rate of 15° C./h or less in a temperature range of 1000° C. to 1100° C. in the finish annealing.

7. The manufacturing method of the grain-oriented electrical steel sheet according to claim 1, wherein the step of causing the secondary recrystallization includes keeping the coated decarburization-annealed steel strip in a temperature range of 1000° C. to 1100° C. for 10 hours or longer in the finish annealing.

8. The manufacturing method of the grain-oriented electrical steel sheet according to claim 2, wherein step of the causing the secondary recrystallization includes keeping the coated decarburization-annealed steel strip in a temperature range of 1000° C. to 1100° C. for 10 hours or longer in the finish annealing.

9. The manufacturing method of the grain-oriented electrical steel sheet according to claim 3, wherein the step of causing the secondary recrystallization includes keeping the coated decarburization-annealed steel strip in a temperature range of 1000° C. to 1100° C. for 10 hours or longer in the finish annealing.

10. The manufacturing method of the grain-oriented electrical steel sheet according to claim 4, wherein the step of causing the secondary recrystallization includes keeping the coated decarburization-annealed steel strip in a temperature range of 1000° C. to 1100° C. for 10 hours or longer in the finish annealing.

11. The manufacturing method of the grain-oriented electrical steel sheet according to claim 5, wherein the step of causing the secondary recrystallization includes keeping the coated decarburization-annealed steel strip in a temperature range of 1000° C. to 1100° C. for 10 hours or longer in the finish annealing.

12. The manufacturing method of the grain-oriented electrical steel sheet according to claim 6, wherein the step of causing the secondary recrystallization includes keeping the coated decarburization-annealed steel strip in a temperature range of 1000° C. to 1100° C. for 10 hours or longer in the finish annealing.

13. The manufacturing method of the grain-oriented electrical steel sheet according to claim 1, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

14. The manufacturing method of the grain-oriented electrical steel sheet according to claim 2, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

15. The manufacturing method of the grain-oriented electrical steel sheet according to claim 3, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

16. The manufacturing method of the grain-oriented electrical steel sheet according to claim 4, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

17. The manufacturing method of the grain-oriented electrical steel sheet according to claim 5, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

18. The manufacturing method of the grain-oriented electrical steel sheet according to claim 6, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

19. The manufacturing method of the grain-oriented electrical steel sheet according to claim 7, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

20. The manufacturing method of the grain-oriented electrical steel sheet according to claim 8, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

21. The manufacturing method of the grain-oriented electrical steel sheet according to claim 9, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

22. The manufacturing method of the grain-oriented electrical steel sheet according to claim 10, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

23. The manufacturing method of the grain-oriented electrical steel sheet according to claim 11, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

24. The manufacturing method of the grain-oriented electrical steel sheet according to claim 12, wherein the silicon steel material further contains at least one element selected from a group consisting of Cr: 0.3 mass % or less, Cu: 0.4 mass % or less, Ni: 1 mass % or less, P: 0.5 mass % or less, Mo: 0.1 mass % or less, Sn: 0.3 mass % or less, Sb: 0.3 mass % or less, and Bi: 0.01 mass % or less.

25. The manufacturing method of the grain-oriented electrical steel sheet according to claim 1, wherein BN precipitates during the step of heating the silicon steel material.

* * * * *